US006082337A

United States Patent [19]

Fujimoto et al.

[11] Patent Number: 6,082,337

[45] Date of Patent: Jul. 4, 2000

[54] ABNORMALITY DETECTION APPARATUS FOR PREVENTING FUEL GAS EMISSION

[75] Inventors: Takeshi Fujimoto, Kariya; Masaaki Nakayama, Toyoake; Yasuo Mukai, Kariya; Hisayo Dohta, Chiryu; Keiji Wakahara, Nagoya; Junya Morikawa, Toyota; Makoto Miwa, Kariya, all of Japan

[73] Assignee: Denso Corporation, Japan

[21] Appl. No.: 09/113,281

[22] Filed: Jul. 10, 1998

[30] Foreign Application Priority Data

| | | | |
|---|---|---|---|
| Jul. 11, 1997 | [JP] | Japan | 9-186843 |
| Jul. 11, 1997 | [JP] | Japan | 9-186844 |
| Jul. 31, 1997 | [JP] | Japan | 9-206029 |
| Jun. 1, 1998 | [JP] | Japan | 10-151626 |
| Jun. 5, 1998 | [JP] | Japan | 10-157515 |

[51] Int. Cl.[7] ..... F02M 37/04

[52] U.S. Cl. ..... 123/520

[58] Field of Search ..... 123/516, 518, 123/519, 520; 73/119 A

[56] References Cited

U.S. PATENT DOCUMENTS

| | | | |
|---|---|---|---|
| 5,146,902 | 9/1992 | Cook et al. | 123/519 |
| 5,158,054 | 10/1992 | Otsuka | 123/520 |
| 5,295,472 | 3/1994 | Otsuka et al. | 123/520 |
| 5,317,909 | 6/1994 | Yamada et al. | 123/520 |
| 5,333,589 | 8/1994 | Otsuka | 123/520 |
| 5,355,863 | 10/1994 | Yamanaka et al. | 123/520 |
| 5,363,828 | 11/1994 | Yamashita et al. | 123/520 |
| 5,425,344 | 6/1995 | Otsuka et al. | 123/520 |
| 5,448,980 | 9/1995 | Kawamura et al. | 123/520 |
| 5,460,143 | 10/1995 | Narita | 123/520 |
| 5,495,842 | 3/1996 | Yamanaka et al. | 123/520 |
| 5,575,265 | 11/1996 | Kurihara et al. | 123/520 |
| 5,857,447 | 1/1999 | Shinohara | 123/520 |
| 5,878,727 | 3/1999 | Huls | 123/520 |
| 5,884,610 | 3/1999 | Reddy | 123/520 |

FOREIGN PATENT DOCUMENTS 9-53531 of 0000 Japan .

*Primary Examiner*—Thomas N. Moulis
*Attorney, Agent, or Firm*—Nixon & Vanderhye PC

[57] ABSTRACT

When a diagnosis execution condition is established, a canister closure valve is closed, thereafter, a purge control valve is opened, a purge control valve is closed in a state where negative pressure is introduced into an evaporated gas system to thereby maintain the evaporated gas system in a hermetically-sealed state and the hermetically-sealed state is continued until abnormality diagnosis is finished. Time period for maintaining the evaporated gas system in the hermetically-sealed state is divided into three time periods of a pressure change determining time period at a first time, an awaiting time period and a pressure change determining time period at a second time. After determining a pressure change amount DPT1 of the evaporated gas system in the pressure change determining time period at the first time, the evaporated gas system is successively maintained in the hermetically-sealed state, after the predetermined awaiting time period has elapsed, the pressure change determination at the second time is carried out by which a pressure change amount DPT2 of the evaporated gas system is determined. Further, presence or absence of leakage of the evaporated gas system is diagnosed by comparing the pressure change amount DPT1 at the first time with the pressure change amount DPT2 at the second time.

28 Claims, 26 Drawing Sheets

START
2001
DIAGNOSIS CONDITION ?
NO
END
YES
2002
F 1=1?
YES
NO
2003
F 2=1?
YES
1
NO
2004
F x=1?
YES
2
NO
2005
F 3=1?
YES
3
NO
FULLY CLOSE PURGE CONTROL VALVE
2006
FULLY CLOSE CANISTER CLOSURE VALVE
2007
STORE P1' T←0sec
2008
2009
T≧10 sec?
NO
2010
F1←1
YES
4
END

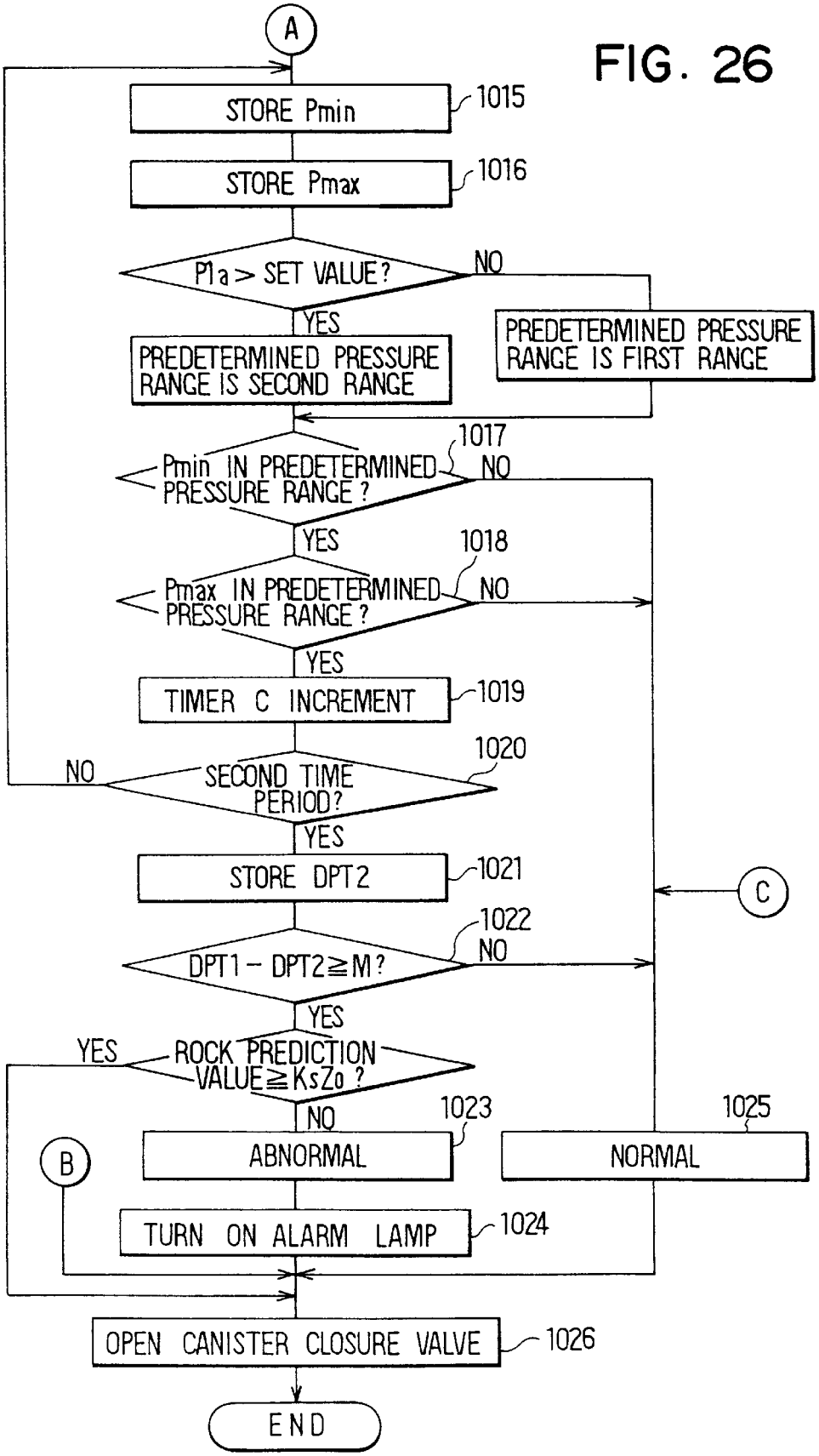
A
FIG. 26
STORE Pmin
1015
STORE Pmax
1016
P1a > SET VALUE?
NO
YES
PREDETERMINED PRESSURE RANGE IS SECOND RANGE
PREDETERMINED PRESSURE RANGE IS FIRST RANGE
1017
Pmin IN PREDETERMINED PRESSURE RANGE ?
NO
YES
1018
Pmax IN PREDETERMINED PRESSURE RANGE ?
NO
YES
TIMER C INCREMENT
1019
1020
NO
SECOND TIME PERIOD?
YES
STORE DPT2
1021
C
1022
DPT1 − DPT2≧M?
NO
YES
YES
ROCK PREDICTION VALUE≧KsZo ?
NO
1023
1025
B
ABNORMAL
NORMAL
TURN ON ALARM LAMP
1024
OPEN CANISTER CLOSURE VALVE
1026
END

ABNORMALITY DETECTION APPARATUS FOR PREVENTING FUEL GAS EMISSION

CROSS REFERENCE TO RELATED APPICATION

This application is based on and incorporates herein by reference Japanese Patent Application Nos. Hei. 9-186843 filed on Jul. 11, 1997, Hei. 9-186844 filed on Jul. 11, 1997, Hei. 9-206029 filed on Jul. 31, 1997, Hei. 10-151626 filed on Jun. 1, 1998, and Hei. 10-157515 filed on Jun. 5, 1998.

BACKGROUND OF THE INVENTION

1. Field of the Invention

The present invention relates to an abnormality diagnosis apparatus of an evaporated gas purge system for diagnosing presence or absence of abnormality of an evaporated gas purge system for purging (discharging) evaporated gas (evaporated fuel) produced by evaporating fuel in a fuel tank to an intake pipe of an internal combustion engine.

2. Description of Related Art

Conventionally, in an evaporated gas purge system, in order to prevent evaporated gas generated from inside of a fuel tank from leaking out into the atmosphere, evaporated gas in the fuel tank is adsorbed in a canister via an evaporated gas passage, a purge control valve is installed at a midway of a purge passage for purging evaporated gas adsorbed in the canister to an intake pipe of an internal combustion engine and the purge control valve is controlled to open or close in accordance with an operating state of the internal combustion engine by which a purge flow rate of evaporated gas for purging from the canister to the intake pipe is controlled. In order to prevent an abnormality where evaporated gas leaks from the evaporated gas purge system to the atmosphere from being left for a long period of time, leakage of evaporated gas needs to detect at an early stage.

According to a conventional general method of abnormality diagnosis, a pressure sensor for detecting pressure in an evaporated gas system from a fuel tank to a purge control valve is installed, negative pressure (pressure at an intake pipe) is introduced into the evaporated gas system by opening the purge control valve and thereafter, the purge control valve is closed and a change in the pressure at inside of the evaporated gas system is detected by a pressure sensor in a state where the evaporated gas system is hermetically sealed and leakage of the evaporated gas system is detected by a degree of the change in the pressure.

However, the change in the pressure at inside of the evaporated gas system under the abnormality diagnosis, is significantly influenced by an amount of generating evaporated gas evaporated from fuel in the fuel tank and the amount of generating evaporated gas is changed by temperature of fuel, properties of fuel and so on and therefore, according to the conventional general method of abnormality diagnosis, it is impossible to determine whether the change in the pressure in the evaporated gas system is caused by leakage of the evaporated gas system or generation of evaporated gas and leakage of the evaporated gas system cannot be detected accurately.

In order to resolve the problem, as disclosed in Japanese Patent Application Laid-Open No. 5-125997, there has been a technology in which the atmosphere is introduced into an evaporated gas system, a pressure change amount $\Delta P1$ in the evaporated gas system in respect of the atmospheric pressure is detected in a state where the evaporated gas system is hermetically sealed, thereafter, a purge control valve is temporarily opened, negative pressure is introduced into the evaporated gas system, a pressure change amount $\Delta P2$ in the evaporated gas system in respect of the negative pressure is detected and leakage of the evaporated gas system is diagnosed by comparing the pressure change amounts $\Delta P1$ and $\Delta P2$ in the two detecting operation.

According to the abnormality diagnosing method of the publication, after detecting the pressure change amount $\Delta P1$ at a first time and before detecting the pressure change amount $\Delta P2$ at a second time, the negative pressure is introduced into the evaporated gas system by temporarily opening a purge control valve and accordingly, strong air flow is caused in the evaporated gas system by introducing the negative pressure. By the strong air flow, evaporated gas adsorbed in the canister flows out or a change in temperature at inside of a fuel tank or a change in concentration of evaporated gas is caused and accordingly, the evaporated gas condition in detecting the pressure change amount $\Delta P2$ at the second time differs from the evaporated gas condition in detecting the pressure change amount $\Delta P1$ at the first time. Even when the pressure change amounts $\Delta P1$ and $\Delta P2$ which are detected under different evaporated gas conditions are compared with each other, the influence of the change in the pressure caused by generation of evaporated gas cannot be canceled out and leakage of the evaporated gas system cannot be diagnosed accurately.

Further, according to the conventional apparatus mentioned above, when the inside of a hermetically-sealed section is adjusted to a predetermined negative pressure level, fuel gas is abruptly generated immediately after adjustment of pressure. Accordingly, even when rubber hose or the like forming a purge passage is not distracted and no leakage of fuel is caused, an amount of change in the pressure state is comparatively enlarged. Meanwhile, when a hole having a very small diameter (for example, hole of about diameter $\phi$0.5 mm) is perforated in the rubber hose, the amount of change in the pressure caused by the leakage is comparatively reduced since the amount of leakage of fuel gas is comparatively small.

According to the conventional device in which presence or absence of abnormality is detected by the amount of change in the pressure from a predetermined negative pressure level to a side of positive pressure in the hermetically-sealed section, there poses a problem from reason mentioned above where even when a very small hole is perforated, it is difficult to discriminate whether the change in the pressure state in this occasion is caused by generation of a large amount of fuel gas immediately after the pressure adjustment or by the very small hole.

Further, when, for example, an automobile is running on an unpaved deteriorated road, curving or abruptly stopped, fuel in a fuel tank is rocked and the pressure change state is unpreparedly varied due to the rocking. Therefore, occurrence of abnormality in the fuel gas emission preventing apparatus may erroneously be detected.

SUMMARY OF THE INVENTION

The present invention has been carried out in consideration of such a situation and therefore, it is an object of the present invention to provide an abnormality diagnosis apparatus of an evaporated gas purge system capable of diagnosing leakage of an evaporated gas system with high accuracy.

In order to achieve the above-described object, according to an abnormality diagnosis apparatus of an evaporated gas purge system, in diagnosing operation, controlling means closes a canister closure valve and opens a purge control valve when a diagnosis execution condition is established, opens the purge control valve in a state where negative pressure is introduced in the evaporated gas system, maintains the evaporated gas system in a hermetically sealed state, determines a change in pressure in the evaporated gas system from a detected value of pressure detecting means during a plurality of pressure change determining time periods in a time period where the evaporated gas system is maintained in the hermetically-sealed state and determines presence or absence of leakage of the evaporated gas system from a result of the determination.

According to the constitution, the evaporated gas system is maintained in the hermetically-sealed state from the determination of the change in the pressure at a first time to the final determination of the change in the pressure and therefore, the determination of the change in the pressure at plural times can be carried out under the same operating gas condition. Thereby, influence on the change in the pressure caused by generation of evaporated gas can be canceled out from a result of the plural times determination of the change in the pressure and leakage in the evaporated gas system can be diagnosed with high accuracy.

Further, when respective time periods for determining the change in the pressure are set to predetermined time periods and a predetermined await time period is set between the respective time periods for determining the change in the pressure, time points for determining the change in the pressure can be made proper. Further, when an amount of the change in the pressure in the evaporated gas system during each of the time periods for determining the change in the pressure, is determined, a degree of the change in the pressure during each of the time periods for determining the change in the pressure can be evaluated simply and accurately.

BRIEF DESCRIPTION OF THE DRAWINGS

FIG. 26 is a flowchart showing processings of abnormality detection in continuation to FIG. 25;

Figure 1:
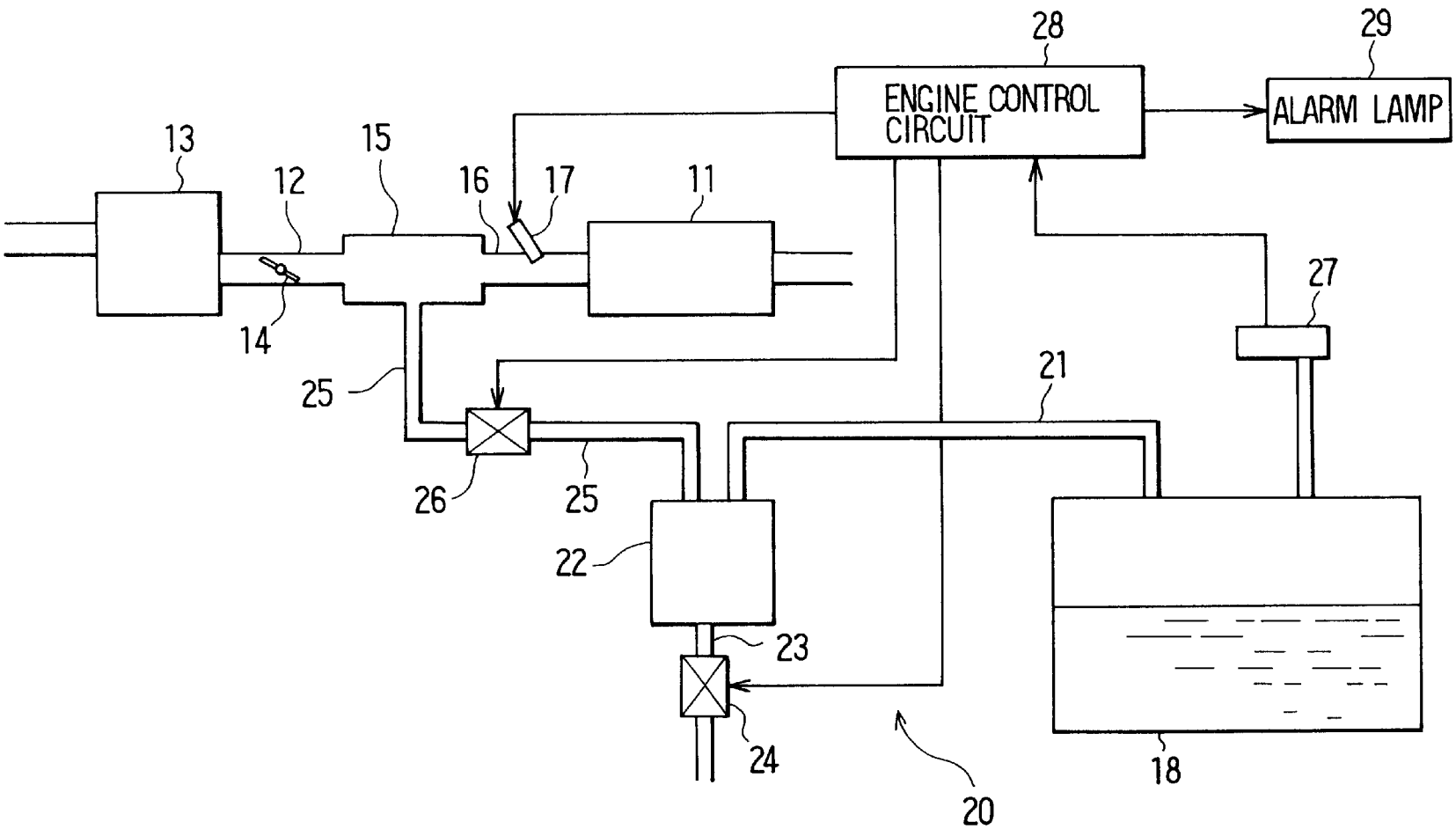
FIG. 1 is an outline constitution diagram of an entire system according to a first embodiment of the present invention.

DETAILED DESCRIPTION OF PREFERRED EMBODIMENTS (First Embodiment)

An explanation will be given of an embodiment according to the present invention in reference to the drawings as follows. An explanation will firstly be given of an outline constitution of an entire system in reference to FIG. 1. An air cleaner 13 is installed on the upstream side of an intake pipe 12 of an engine 11 which is an internal combustion engine, air which has passed through the air cleaner 13 flows into a surge tank 15 via a throttle valve 14 and sucked into respective cylinders of the engine 11 via an intake manifold 16. A fuel injection valve 17 is installed at the intake manifold 16 for each of the cylinders. Fuel in the fuel tank 18 is sent to each of the fuel injection valves 17 via a fuel pipe (not illustrated) by a fuel pump (not illustrated).

Next, an explanation will be given of the constitution of an evaporated gas purge system 20. A canister 22 is connected to the fuel tank 18 via an evaporated gas passage 21. An adsorber (not illustrated) of activated carbon or the like for adsorbing evaporated gas (evaporated fuel) is stored in the canister 22. Further, an atmosphere communication pipe 23 is installed at an atmosphere communication hole in a bottom face portion of the canister 22 and the atmosphere communication hole 23 is attached with a canister closure valve 24.

The canister closure valve 24 is constituted by an electromagnetic valve and is maintained in a closed state when electricity conduction is made OFF and the atmosphere communication pipe 23 of the canister 22 is maintained in a state where it is opened to the atmosphere. When electricity is conducted, the canister closure valve 24 is closed and the atmosphere communication pipe 23 is brought into a state where it is closed.

Meanwhile, a purge passage 25 for purging (discharging) evaporated gas adsorbed to the adsorber of the canister 22 to the intake pipe 12 is installed between the canister 22 and the surge tank 15 of the intake pipe 12, and a purge control valve 26 for adjusting a purge flow rate is installed at a midway of the purge passage 25. The purge control valve 26 is constituted by an electromagnetic valve for controlling the purge flow rate of evaporated gas from the canister 22 to the intake pipe 12 by carrying out duty control.

Further, the fuel tank 18 is installed with a pressure sensor 27 (pressure detecting means) for detecting inner pressure thereof. When the evaporated gas system from inside of the fuel tank 18 to the purge control valve 26 is hermetically sealed, the inner pressure of the fuel tank 18 coincides with inner pressure at other portion of the evaporated gas system and therefore, the inner pressure of the evaporated gas system can be detected by detecting the inner pressure of the fuel tank 18 by the pressure sensor 27.

An output signal from the pressure sensor 27 is read by an engine control circuit 28. The engine control circuit 28 is mainly constituted by a microcomputer and carries out fuel injection control, ignition control and purge control by executing a fuel injection control program, an ignition control program and a purge control program stored to ROM (Read Only Memory) (not illustrated) thereof. Further, the engine control circuit 28 functions as abnormality diagnosing means for diagnosing presence or absence of leakage of the evaporated gas system by executing a program of diagnosing abnormality of evaporated gas system shown by FIG. 2 and FIG. 3 stored to ROM, and diagnosing operation controlling means for controlling opening and closing operation of the purge control valve 26 and the canister closure valve 24 in diagnosing abnormality, and alarms an operator by turning on an alarm lamp 29 when leakage of the evaporated gas system is detected.

Figure 4:
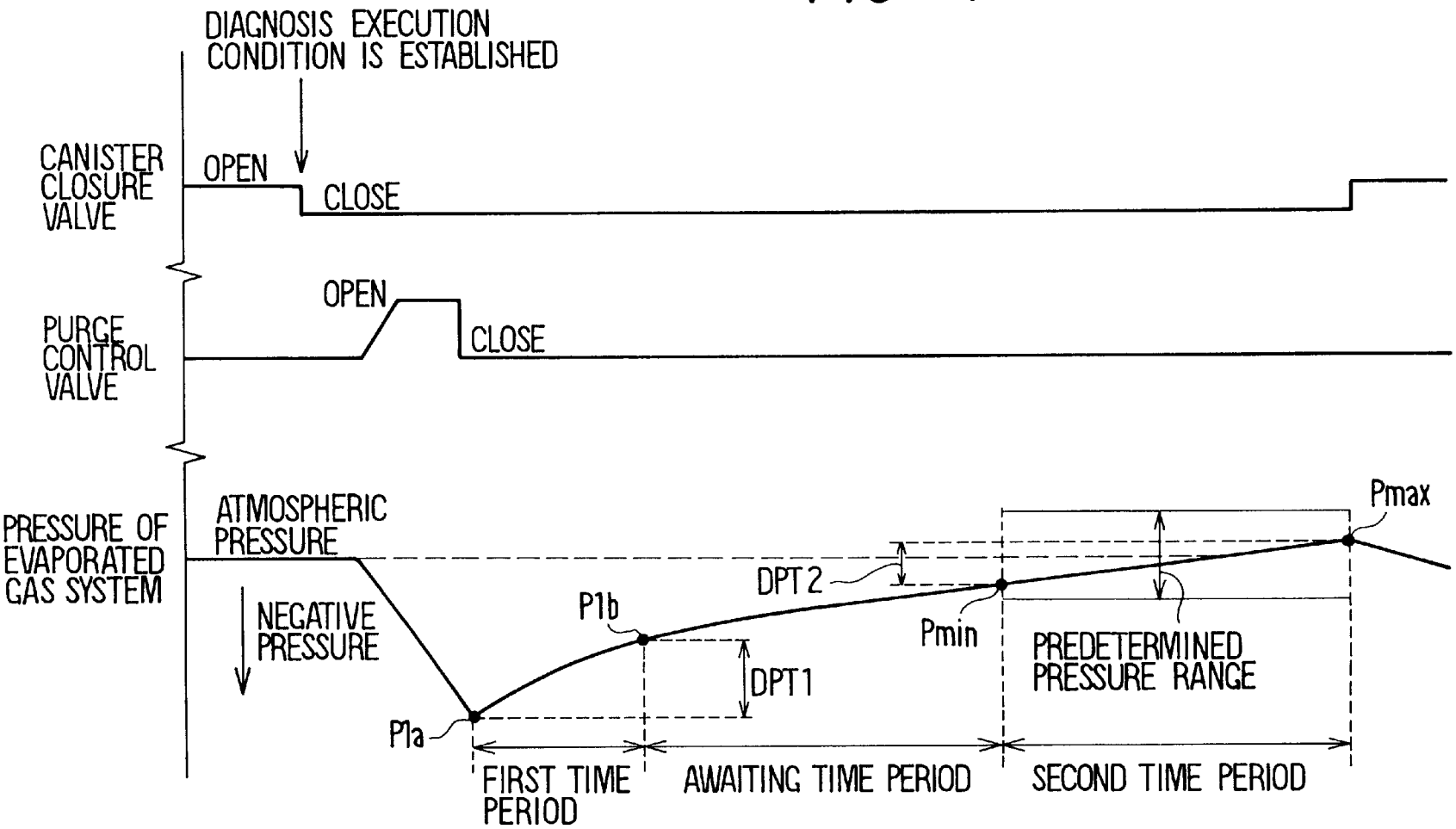
FIG. 4 illustrates time charts showing an example of opening and closing operation of a canister closure valve and a purge control valve and a change in pressure of an evaporated gas system in carrying out abnormality diagnosis.

At this point, a general explanation will be given of a diagnosis procedure carried out by a program for diagnosing abnormality of the evaporated gas system in reference to FIG. 4. When the diagnosis execution condition is established, the canister closure valve 24 is opened, thereafter, the purge control valve 26 is opened, in a state where negative pressure (pressure at intake pipe) is introduced into the evaporated gas system, the purge control valve 26 is closed whereby the evaporated gas system is maintained in a hermetically-closed state and the hermetically-sealed state is continued until the abnormality diagnosis is finished. Further, a time period where the evaporated gas system is maintained in the hermetically-sealed state is divided into three time periods of a pressure change determining time period at a first time, an awaiting time period and a pressure change determining time period at a second time.

During the pressure change determining time period at the first time, a pressure change amount DPT1 of the evaporated gas system is determined, when the pressure change amount DPT1 is smaller than a determinant L (that is, when the pressure change amount DPT1 is constituted only by a pressure change amount caused by generation of evaporated gas), no leakage occurs in the evaporated gas system, the system is determined to be normal and the abnormality diagnosis is finished. In this case, the canister closure valve 24 is immediately opened and the system returns to normal purge control.

When the pressure change amount DPT1 is equal to or larger than the determinant L, the leakage of the evaporated gas system may occur and therefore, even after finishing the pressure change determining time period at the first time, the evaporated gas system is maintained successively in the hermetically-closed state and the system awaits for elapse of the predetermined awaiting time period. Further, when the awaiting time period has elapsed, the system proceeds to the pressure change determining time period at the second time.

When the pressure of the evaporated gas system is deviated from a predetermined pressure range (range where leakage of evaporated gas system may occur) at the start of the pressure change determining time period at the second time, the system is determined to be normal, the determination of pressure change is interrupted and the abnormality diagnosis is finished. In this case, the canister closure valve 24 is immediately opened and the system returns to normal purge control.

Further, when the pressure of the evaporated gas system is deviated from the predetermined pressure range (range where leakage of evaporated gas system may occur) during the pressure change determining time period at the second time, the system is determined to be normal, the determination of the pressure change is interrupted, the abnormality diagnosis is finished, the canister closure valve 24 is opened and the system returns to normal purge control.

Meanwhile, when the pressure of the evaporated gas system falls in a predetermined pressure range (range where leakage of the evaporated gas system may occur) during the pressure change determining time period at the second time, a pressure change amount DPT2 of the evaporated gas system during the pressure change determining time period is determined, and presence or absence of leakage of the evaporated gas system is diagnosed by comparing the pressure change amount DPT1 at the first time with the pressure change amount DPT2 at the second time. Thereafter, the canister closure valve 24 is opened and the system returns to normal purge control.

Figure 2:
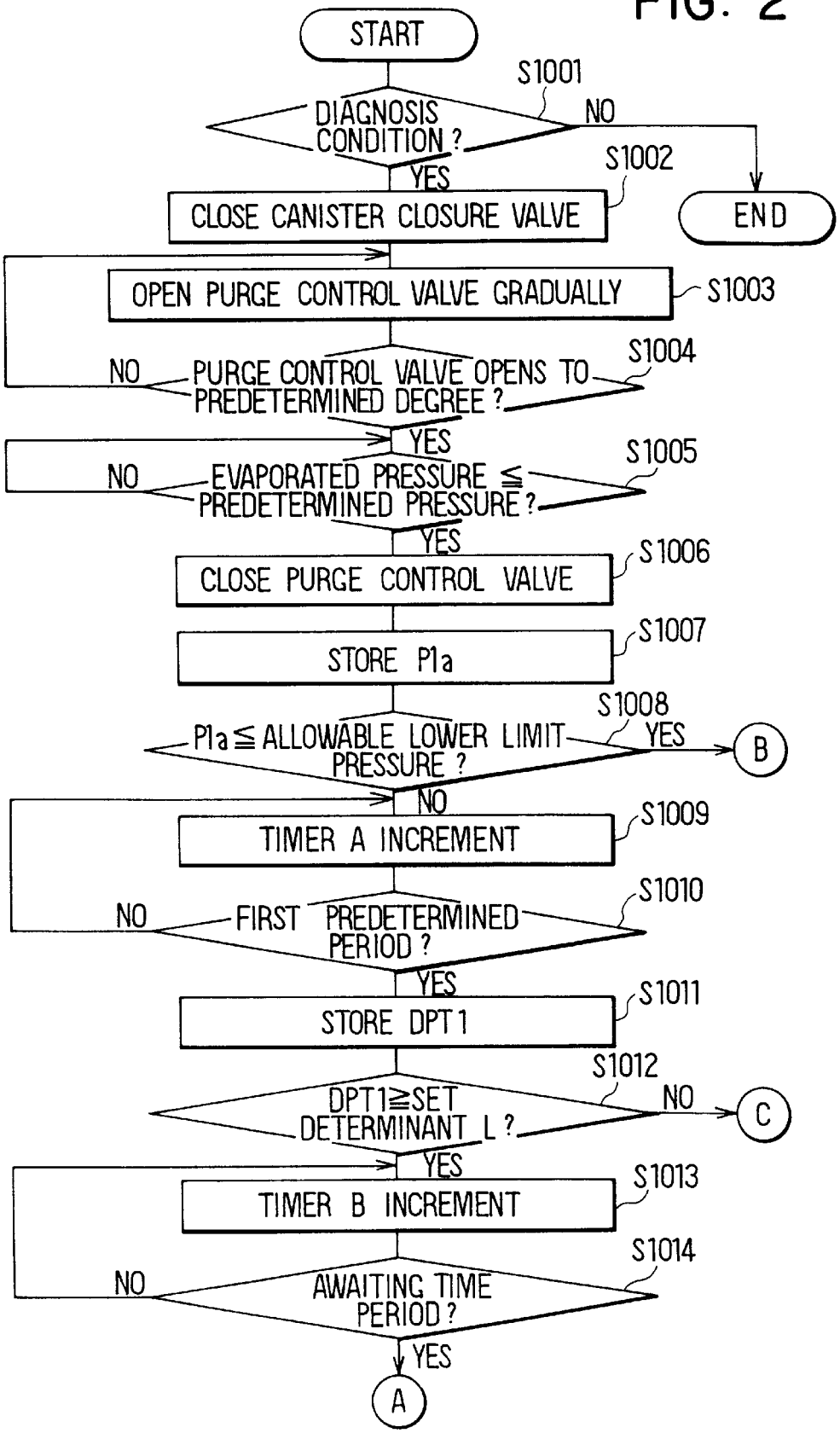
FIG. 2 is a flowchart showing a flow of processings at an earlier half of a program for diagnosing abnormality in an evaporated gas system.
Figure 3:
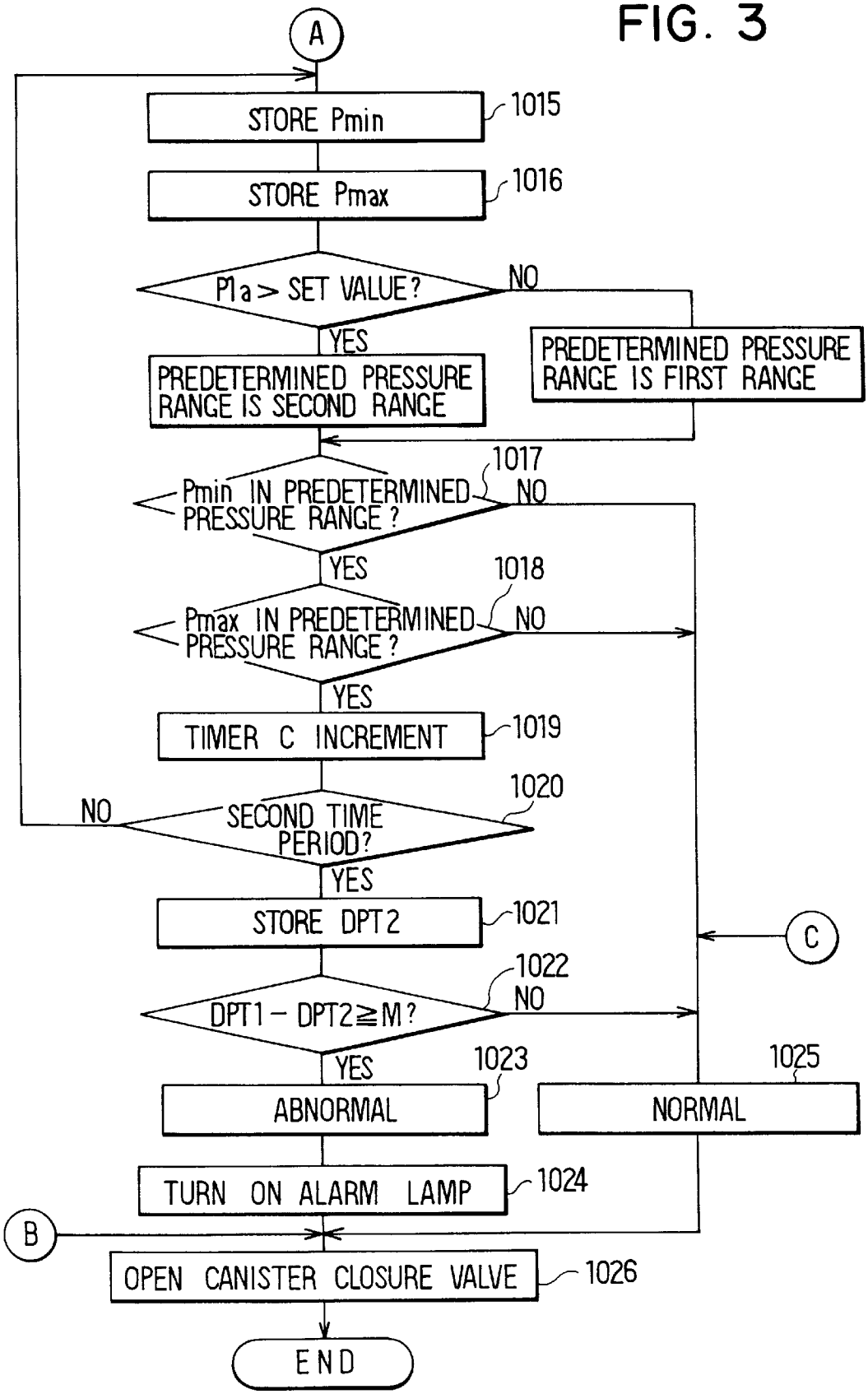
FIG. 3 is a flowchart showing a flow of processings at a later half of the program for diagnosing abnormality in an evaporated gas system.

The abnormality diagnosis of the evaporated gas system explained above is executed at every predetermined time by the evaporated gas system abnormality diagnosing program shown by FIG. 2 and FIG. 3. When the processing of the program is started, whether the diagnosis execution condition is established is determined firstly at step 1001. The diagnosis execution condition is established when the operating state of engine is stabilized, and the determination is carried out by, for example, an intake air amount, an intake air temperature, elapse time period after starting, whether the air to fuel ratio is being fed back or the like. When the diagnosis execution condition is not established, the program is finished without carrying out the abnormality diagnosis processings thereafter.

Meanwhile, when the diagnosis execution condition is established, the operation proceeds to step 1002 where the canister closure valve 24 is closed and thereafter, in steps 1003 and 1004, the purge control valve 26 is gradually opened and the purge control valve 26 is opened to a predetermined opening degree by which negative pressure is introduced into the evaporated gas system. In this case, the reason for gradually opening the purge control valve 26 is that adverse influence on the drivability is reduced and flow of air into the evaporated gas system is made gradual when negative pressure is introduced.

Under a state where the purge control valve 26 is opened to the predetermined opening degree, the operation awaits until the pressure of the evaporated gas system detected by the pressure sensor 27 becomes equal to or lower than the predetermined pressure (step 1005) and the purge control valve 26 is closed at a time point when the pressure of the evaporated gas system becomes equal to or lower than the predetermined pressure (step 1006) by which the evaporated gas system is hermetically sealed.

Thereafter, at step 1007, a current pressure P1*a* of the evaporated gas system is read and stored to RAM (not illustrated), at a next step 1008, whether the pressure Pla of the evaporated gas system is equal to or lower than an allowable lower limit pressure is determined, when the pressure P1*a* is equal to or lower than the allowable lower limit pressure (when introduced negative pressure is excessively large), the abnormality diagnosis cannot be carried out with high accuracy and therefore, the operation proceeds to step 1026 of FIG. 3 where the canister closure valve 24 is opened and the hermetically-sealed state of the evaporated gas system is released.

When pressure P1*a* of the evaporated gas system is higher than allowable lower limit pressure, the operation proceeds to step 1009 of FIG. 2 where elapse time period after starting the pressure change determining time period at the first time is counted by a timer A. Thereafter, the processing of incrementing the timer A at every constant time period is repeated until a first predetermined time period previously set has elapsed as the pressure change determining time period at the first time (steps 1009, 1010), at a time point where the time period counted by the timer A has reached the first predetermined time period, the operation proceeds to step 1011 where a difference DPT1 between a pressure P1*b* of the evaporated gas system when the pressure change determining time period at the first time has been finished and the pressure P1*a* of the evaporated gas system when it is started, that is, the pressure change amount DPT1 of the evaporated gas system during the pressure change determining time period at the first time, is calculated and stored to RAM (not illustrated).

Thereafter, at step 1012, the pressure change amount DPT1 of the evaporated gas system in the pressure change determining time period at the first time, is compared with the previously set determinant L. In this case, the determinant L is set to a value which is equal to or smaller than a pressure change amount caused by generation of evaporated gas during pressure change determining time period at the first time. Accordingly, when the pressure change amount DPT1 is smaller than the determinant L, it can be determined that leakage of the evaporated gas system has not occurred and accordingly, the system is determined to normal (step 1025), the canister closure valve 24 is opened (step 1026) and the system returns to the normal purge control.

Meanwhile, when the pressure change amount DPT1 is equal to or larger than the determinant L, leakage of the evaporated gas system may occur and therefore, the evaporated gas system is maintained in the hermetically-sealed state successively even after determination of the pressure change determining time period at the first time, elapse time period after finishing the pressure change determining time period at the first time is counted by a timer B and the operation awaits until elapse of a predetermined awaiting time period (steps 1013, 1014). The determination of the pressure change is not carried out during the awaiting time period.

Thereafter, at a time point where the predetermined awaiting time period has elapsed, the operation proceeds to the pressure change determining time period at the second time and a minimum value Pmin of the pressure of the evaporated gas system is stored at step 1015 of FIG. 3. The minimum value Pmin of the pressure of the evaporated gas system is updated at any time during the pressure change determining time period at the second time. Further, a maximum value Pmax of the pressure of the evaporated gas system is stored at the next step 1016. Also the maximum value Pmax of the pressure of the evaporated gas system is updated at any time during the pressure change determining time period at the second time.

During the pressure change determining time period at the second time, whether the minimum value of the pressure of the evaporated gas system falls in a predetermined pressure range (range where leakage of evaporated gas system may occur) is determined (step 1017), when the value is deviated from the predetermined pressure range, the system is determined to be normal (step 1025), the determination of the pressure change is interrupted, the canister closure valve 24 is opened (step 1026) and the system returns to normal purge control. By these processings, when the pressure of the evaporated gas system is deviated from the predetermined pressure range during the pressure change determining time period at the second time, the system is determined to be normal and the determination of the pressure change at the second time is interrupted.

Further, during pressure change determining time period at the second time, at step 1018, whether the maximum value Pmax of the pressure of the evaporated gas system falls in a predetermined pressure range (range where leakage of evaporated gas system may occur) is determined, when the value is deviated from the predetermined pressure range, the system is determined to be normal (step 1025), the determination of the pressure change is interrupted, the canister closure valve 24 is opened (step 1026) and the system returns to normal purge control.

Elapse time after start of the pressure change determining time period at the second time is counted by a timer C (step 1019), at a time point where the second predetermined time period previously set has elapsed as the pressure change determining time period at the second time, the operation proceeds to step 1021 where a difference DPT2 between the maximum value Pmax and the minimum value Pmin of the pressure of the evaporated gas system is calculated and stored to RAM. Thereafter, at step 1022, a difference between the pressure change amount DPT1 at the first time and the pressure change amount DPT2 at the second time is calculated and whether the difference (DPT1−DPT2) is equal to or larger than a determinant M previously set, is determined.

When DPT1−DPT2 is smaller than the determinant M, it signifies that the pressure of the evaporated gas system is changed substantially at a similar rate both in the pressure change determining time period at the first time and the pressure change determining time period at the second time and in this case, it can be predicted that the cause of the pressure change is derived from generation of evaporated gas and therefore, the system is determined to be normal (step 1025), the canister closure valve 24 is opened (step 1026) and the system returns to normal purge control.

In contrast thereto, when DPT1−DPT2 is equal to or larger than the determinant M, the pressure change amount DPT1 at the first time is larger and the pressure change amount DPT2 at the second time is smaller. When leakage occurs in the evaporated gas system, the pressure change is increased immediately after introducing negative pressure and the pressure change amount DPT1 at the first time becomes larger whereas the time period for the pressure of the evaporated gas system to rise to a vicinity of the atmospheric pressure is shortened after introducing negative pressure and therefore, the pressure change amount DPT2 at the second time becomes smaller. Accordingly, when DPT1−DPT2 is equal to or larger than the determinant M, the operation proceeds to step 1023 where the system is determined to be abnormal (occurrence of leakage of evaporated gas system) and at a next step 1024, a driver is alarmed by turning on the alarm lamp 29 and the canister closure valve 24 is opened (step 1026).

Further, pressure in the evaporated gas system during the abnormality diagnosis is influenced by an amount of generating evaporated gas and therefore, the predetermined pressure range mentioned above may be varied in accordance with the pressure in the evaporated gas system during the abnormality diagnosis.

That is, when the pressure in the evaporated gas system during the abnormality diagnosis is larger than a certain set value, it is determined that the amount of generating evaporated gas is large and the predetermined pressure range mentioned above is set to a range in consideration of generation of evaporated gas by which erroneous diagnosis caused by generation of evaporated gas can be avoided.

Figure 5:
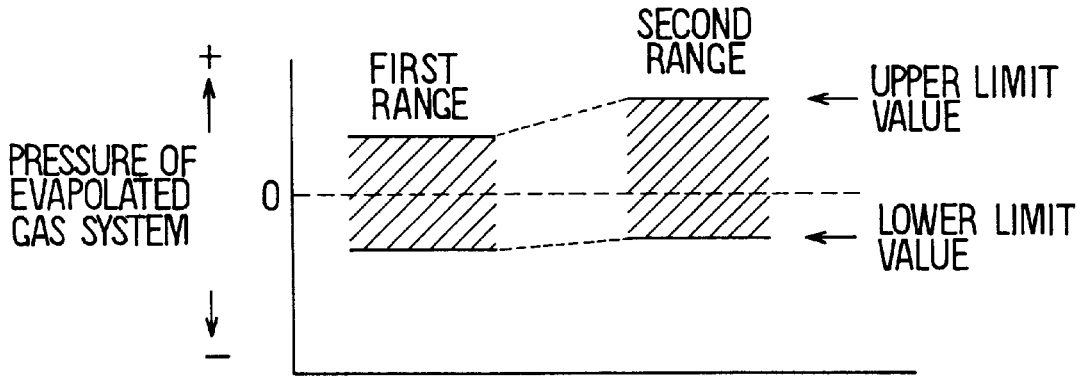
FIG. 5 is a diagram for explaining a change in a predetermined pressure range.

In this case, when a predetermined range which is used in the case where a minimum value of the pressure in the evaporated gas system during the abnormality diagnosis is smaller than a certain set value, is specified as a first range and a predetermined range which is used in the case where it is larger, is specified as a second range, the following relationships are established (refer to FIG. 5).

Upper limit value of first range≦Upper limit value of second range

Lower limit value of first range≦Lower limit value of second range.

Further, P1*a* described in step 1007 is compared with a pressure for determining negative pressure amount, when P1*a* is smaller than the pressure, the predetermined pressure range is set to the first range and when P1*a* is higher than the pressure, the predetermined pressure range is set to the second range.

Further, although in step 1022, presence or absence of leakage of the evaporated gas system is determined by the difference between the pressure change amount DPT1 at the first time and the pressure change amount DPT2 at the second time, the presence or absence of leakage of the evaporated gas system may be determined by a ratio of the pressure change amount DPT1 at the first time to the pressure change amount DPT2 at the second time.

Further, the amount of generating the evaporated gas (pressure change caused by generation of evaporated gas) during the time period where the evaporated gas system is hermetically sealed, is varied by fuel temperature, operating condition or the like and therefore, the determinants L and M for abnormality diagnosis used in steps 1012 and 1022 may be set by a map or the like in accordance with the operating condition influencing on generation of evaporated gas such as fuel temperature (or outside air temperature) or the like.

According to the program of diagnosing abnormality in the evaporated gas system explained above, the evaporated gas system is maintained in the hermetically-sealed state from the determination of pressure change at the first time to the determination of the pressure change at the second time and accordingly, the twice determination of the pressure change can be carried out under the same evaporating condition, different from the conventional case where air flow is caused in the evaporated gas system by temporarily releasing the hermetically sealed state of the evaporated gas system during the abnormality diagnosis. Thereby, influence on the pressure change caused by generation of evaporated gas can be canceled out from a result of twice determination of pressure change and leakage of the evaporated gas system can be diagnosed with high accuracy.

Furthermore, in starting or during the pressure change determining time period at the second time, whether the pressure of the evaporated gas system falls in the predetermined pressure range (range where leakage of evaporated gas system may occur) is determined, when the pressure of the evaporated gas system is deviated from the predetermined pressure range, the determination of the pressure change is immediately interrupted and accordingly, wasteful determination of pressure change is not carried out in normal time and swift abnormality diagnosis can be carried out.

Incidentally, although twice pressure change determining time periods are set in the time period where the evaporated gas system is hermetically sealed according to the embodiment mentioned above, three times or more of the pressure change determining time periods may be set. Further, although according to the above-described embodiment, the pressure change amounts DPT1 and DPT2 in the evaporated gas system during the respective pressure change determining time periods are determined, pressure change rates may be determined. Or, during the respective pressure change determining time periods, a time period where a previously set pressure change amount is reached may be measured by a timer and a time period may be used as an index of pressure change. Further, a plurality of times of pressure change determining time periods may continuously be set without setting awaiting time periods.

Further, the determination of the pressure change in the evaporated gas system may be carried out by one time in the following way. A time period where the evaporated gas system in which negative pressure is introduced is maintained in the hermetically-sealed state, is divided in two time periods of an awaiting time period and a pressure change determining time period and the pressure change determining time period is started after a predetermined amount of the awaiting time period has elapsed since the evaporated gas system has been hermetically sealed. That is, by awaiting for elapse of predetermined awaiting time period since the evaporated gas system has been hermetically sealed under the state of introducing negative pressure, after pressure change caused by generation of evaporated gas or pressure change caused by leakage of the evaporated gas system is caused, the pressure change in the evaporated gas system is successively determined while maintaining the hermetically-sealed state of the evaporated gas system and presence or absence of leakage of the evaporated gas system is diagnosed from a result of the determination.

Also in this case, when the pressure of the evaporated gas system (detected value of the pressure sensor 27) is deviated from the predetermined pressure range in starting the pressure change determining time period or during the pressure change determining time period, the system can be determined as normal and accordingly, the determination of the pressure change may be interrupted. In this way, wasteful determination of pressure change is not carried out in normal time and swift abnormality diagnosis can be carried out.

Further, although according to the example of system constitution of FIG. 1, the inner pressure of the fuel tank 18 is detected by the pressure sensor 27 (pressure detecting means), pressure at, for example, the evaporated gas passage 21 may be detected, in sum, pressure at any location from the fuel tank 18 to the purge control valve 26 may be detected.

(Second Embodiment)

Figure 6:
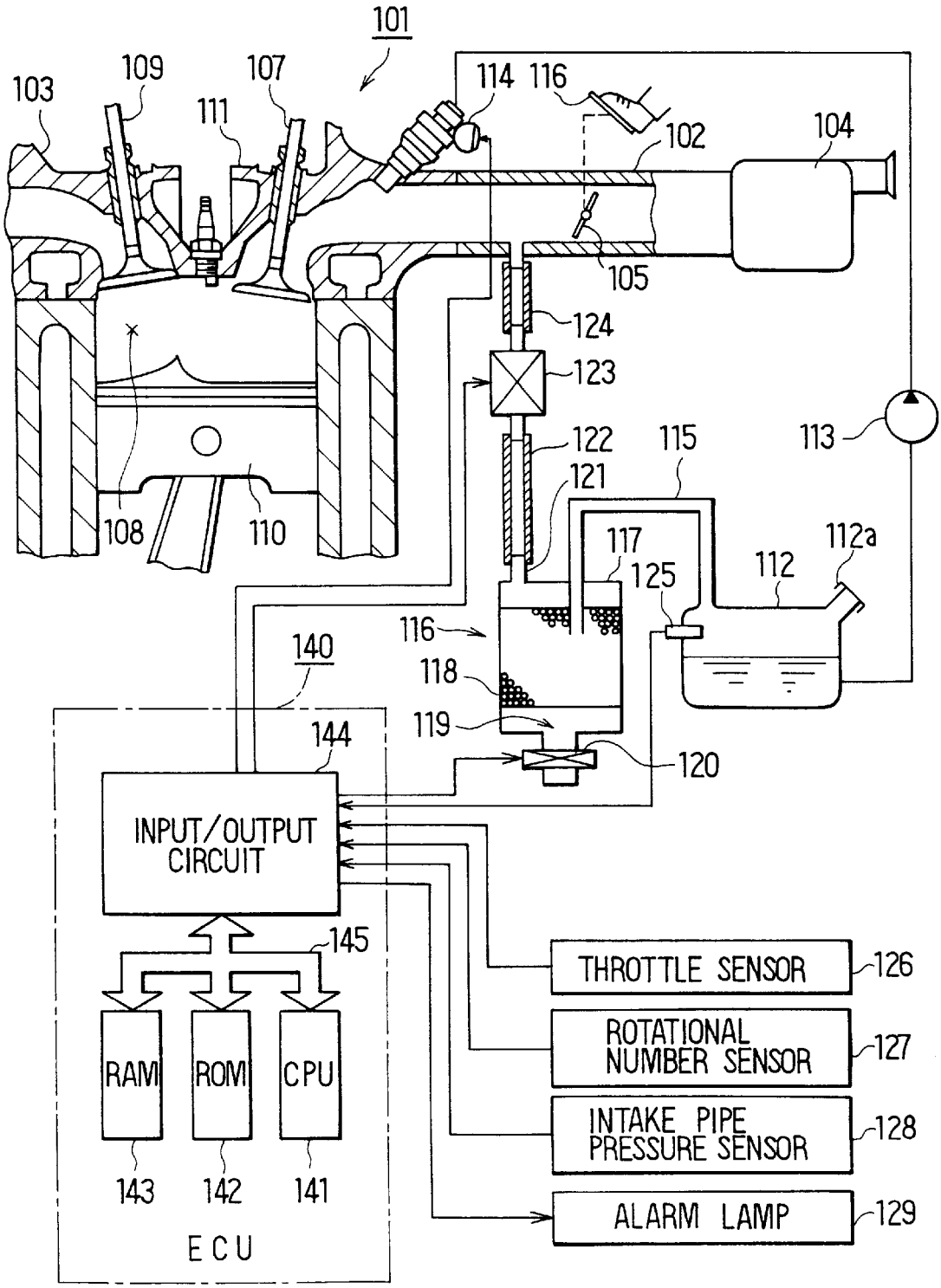
FIG. 6 is an outline constitution diagram of an entire system according to a second embodiment of the present invention.

FIG. 6 is a constitution diagram showing an outline of a fuel injection control system according to a second embodiment. As shown by FIG. 1, an engine 101 is connected with an intake pipe 102 and an exhaust pipe 103. An air cleaner 104 for filtering air is arranged on the upstream side of the intake pipe 102 and air is sucked into the intake pipe 102 via the air cleaner 104. Further, a throttle valve 105 for opening and closing in cooperation with an accelerator pedal 106 is arranged in the intake pipe 102. The sucked air is supplied to a combustion chamber 108 above a piston 110 via the throttle valve 105 as well as an intake valve 107. Further, exhaust gas which has combusted in the combustion chamber 108 is exhausted to the exhaust pipe 103 via an exhaust valve 109.

Meanwhile, a fuel pump 113 is connected to a fuel tank 112 storing liquid fuel (gasoline). Fuel stored in the fuel tank 112 is fed to a fuel injection valve 114 in a state compressed by the fuel pump 113 and is supplied to inject into the intake pipe 102 in accordance with opening operation of the fuel injection valve 114. That is, fuel which has been supplied to inject is mixed with the sucked air in the combustion chamber 108 and is combusted.

Further, the fuel tank 112 is also connected to a canister 116 via a communicating type 115. Further, respective portions explained below constitute a fuel gas emission preventing device of the engine along with the fuel tank 112 and the communicating pipe 115. That is, in the fuel gas emission preventing device, an adsorber 118 comprising, for example, activated carbon for adsorbing fuel generated in the fuel tank 112 is stored in a canister main body 117. By such a constitution of the device, fuel gas generated in the fuel tank 112 is taken by the canister main body 117 via the communicating pipe 115 and is adsorbed to the adsorber 118 in the canister main body 117.

The canister main body 117 is formed with an atmospheric hole 119 opened to the atmosphere and air can pass between inside and outside of the canister main body 117 via the atmospheric hole 119. The atmospheric hole 119 is arranged with a canister closure valve 120 of an electromagnetically driven type and can be closed as necessary. That is, the canister closure valve 120 brings the atmospheric hole 119 into an opened state when electricity is not conducted to a coil, not illustrated, (OFF) and brings the atmospheric hole 119 into a closed state when electricity is conducted to the coil (ON). Presence or absence of application of voltage mentioned above to the canister closure valve 120 is controlled through ECU 140, mentioned later.

Further, the canister main body 117 is formed with a hose connection portion 121. One end of a purge pipe 122 is mounted to the hose connection portion 121 and other end of the purge pipe 122 is connected with a purge control valve 123 of an electromagnetically driven type. Further, the purge control valve 123 is connected to the downstream side of the throttle valve 105 of the intake pipe 102 via a purge pipe 124.

According to such a structure of the fuel gas emission preventing device, the intake pipe 102 and the canister 116 are brought into a mutually communicated state by opening the purge control valve 123 and conversely, the intake pipe 102 and the canister 116 are brought into a mutually closed state by closing the control valve 123. The fuel gas adsorbed in the adsorber 118 of the canister 116 is introduced into the intake pipe 102 by negative pressure caused in the intake pipe 102 in the above-described mutually communicated state by opening the purge control valve 123.

Figure 7:
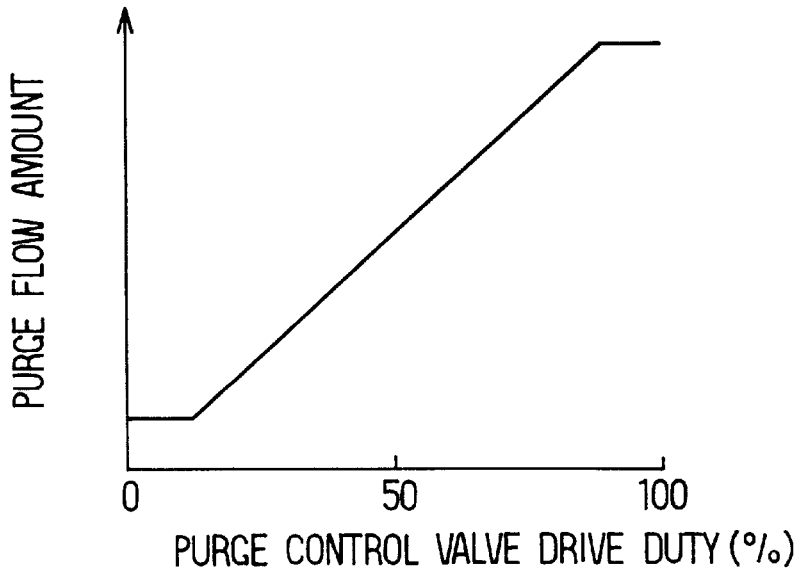
FIG. 7 is a graph showing a duty drive behavior of the purge control valve.

According to the purge control valve 123, when electricity is conducted to a coil, not illustrated, an opening degree thereof, that is, purge flow rate thereof is determined in accordance with an amount of electricity conduction. Further, electricity conduction to the purge control valve 123 is carried out by pulse signals which are controlled by a duty control and the purge flow rate is continuously changed based on a duty ratio of the pulse signal, for example, in accordance with a behavior shown by FIG. 7. The duty control of the purge flow rate is also carried out through ECU 140, mentioned later.

Further, according to the fuel gas emission preventing device, the purge pipes 122 and 124 connected to the purge control valve 123 are formed by a flexible material such as rubber hose, nylon hose or the like. Further, the communicating pipe 115 connecting the fuel tank 112 and the canister 116 is formed partially by a rubber hose or the like.

Meanwhile, the fuel tank 112 is installed with a relief valve 112*a* for escaping pressure in the tank 112 when the pressure exceeds, for example, −40 through 150 hPa. Therefore, even when a pressure variation is caused at a section between the fuel tank 112 to the canister 116, the variation is always restrained to a range of the relief pressure or lower.

Further, the fuel tank 112 is also arranged with a pressure sensor 125 for detecting pressure in the tank 112. An output from the pressure sensor 125 is utilized as a monitor signal in adjusting pressure in the fuel gas emission preventing device. Further, the pressure sensor 125 is sufficient with a structure capable of withstanding the range of the relief pressure. Further, according to an apparatus of the embodiment, a pressure difference sensor for detecting pressure difference (relative pressure) between the inner pressure of the tank and the atmospheric pressure is used as the pressure sensor 125.

As other members, also as shown by FIG. 6, the system is respectively installed with a throttle sensor 126 for detecting the opening degree of the throttle valve 105, a rotational number sensor 127 for detecting the rotational number of the engine 101 and an intake pipe pressure sensor 128 for detecting pressure in the intake pipe 102. All of outputs of the respective sensors are taken by ECU 140.

ECU 140 is constituted by well-known CPU 141 as well as ROM 142 where operation program of control or the like and data are previously stored, RAM 143 where control data or the like is temporarily stored and an input and output circuit 144 connected to various kinds of the sensors or the actuators mentioned above which are connected to each other via a common bus 145. ECU 140 generally executes fuel injection control as well as canister purge control and so on by driving the fuel injection valve and driving the purge control valve 123 or the canister closure valve 120 based on detection signals from the various kinds of the sensors.

At this point, a brief explanation will be given of an outline of the control system executed by ECU 140. That is, ECU 140 calculates a basic fuel injection amount in respect of the engine 101 based on an output (rotational number NE) from the rotational number sensor 127 and an output (intake pressure PM) from the intake pipe pressure sensor 128, carries out various kinds of correction such as correction of an air to fuel ratio or the like in respect of the basic fuel injection amount and calculates a final fuel injection amount. Further, ECU 140 drives the fuel injection valve 114 for a time period designated by the final fuel injection amount in synchronism with the intake stroke of the engine 101.

Further, ECU 140 detects fuel gas concentration (evaporated gas concentration) in the fuel gas emission preventing device on the basis of the feedback correction coefficient FAF based on, for example, an amount of deviation in the air to fuel ratio and sets information of the opening degree of the purge control valve 123, that is, the purge flow rate in correspondence with the detected fuel gas concentration. In carrying out the purge control, ECU 140 determines each stage of the opening degree of the purge control valve 123 in reference to the opening degree information and controls the opening degree of the purge control valve 123 compatible with the determined opening degree by a duty control. Further, opening and closing of the canister closure valve 120 is adjusted in order to control the pressure in the fuel gas emission preventing device (pressure in the canister 116 or the fuel tank 112) in a predetermined manner.

Further, ECU 140 executes abnormality detecting processings of the fuel gas emission preventing device which will be described in details as follows and when occurrence of abnormality such as leakage of fuel gas in the fuel gas emission preventing device is detected in the processings, ECU 140 informs a passenger of a vehicle or the like of occurrence of abnormality by alarming by turning on an abnormality alarming lamp 129.

Figure 8:
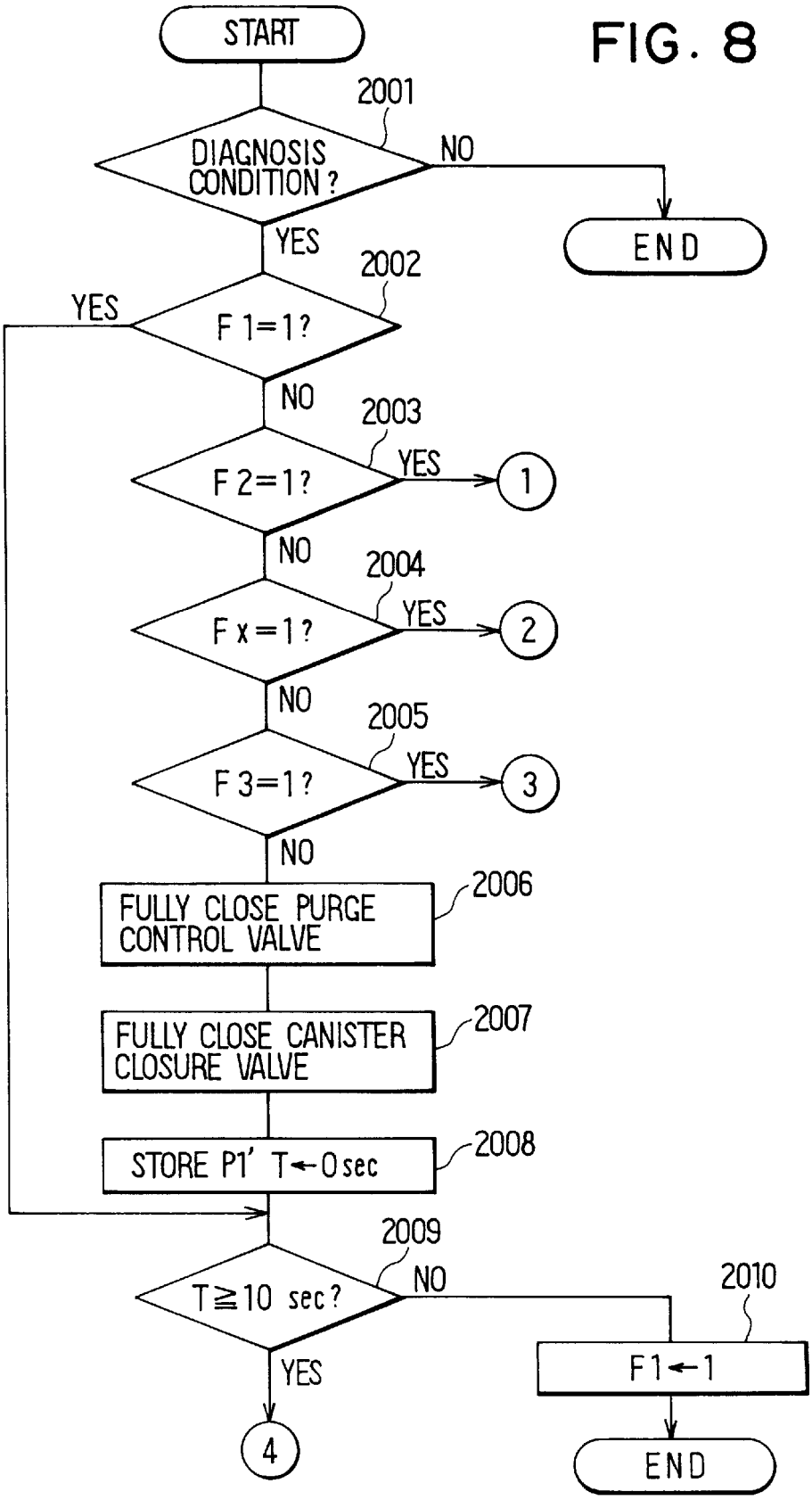
FIG. 8 is a flowchart showing processings of abnormality detection.
Figure 9:
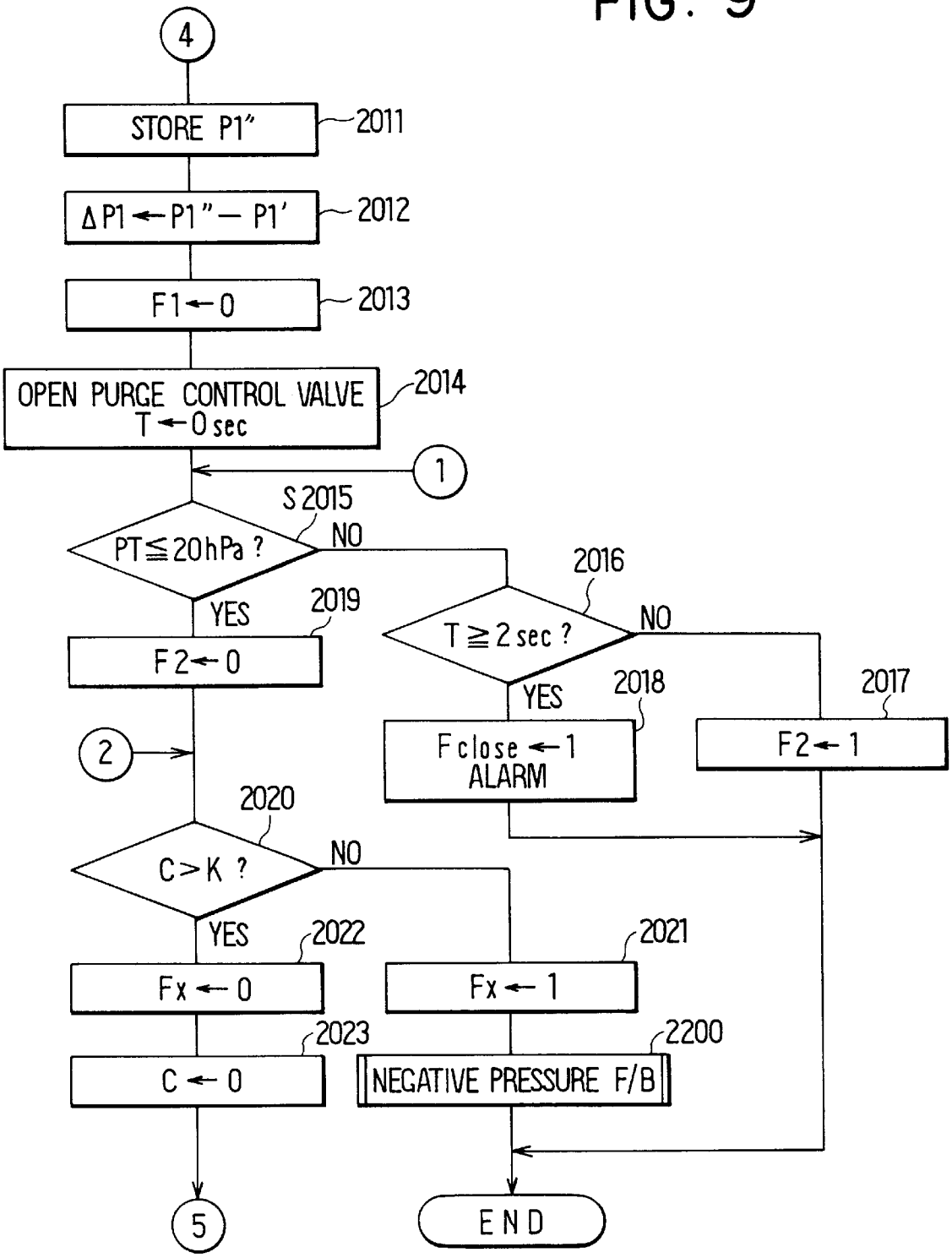
FIG. 9 is a flowchart showing processings of abnormality detection in continuation to FIG. 8.

Next, an explanation will be given of processings of detecting abnormality of the fuel gas emission preventing device among various kinds of operational processings carried out by CPU 141 in ECU 140 in reference to flowcharts of FIG. 8 through FIG. 11 and time charts of FIG. 12. The processings of FIG. 8 and FIG. 9 are executed repeatedly at every predetermined time (for example, at every 64 milliseconds) along with the fuel injection control processing when an ignition key switch, not illustrated, is turned on. Further, according to the time charts of FIG. 12, a time period shown by time points t1 through t6 in the time charts of FIG. 12, corresponds to a time period for detecting abnormality of leakage of fuel gas from the fuel gas emission preventing device or the like (hereinafter, referred to as leakage check time period for convenience). Incidentally, the inner pressure of tank PT designates a difference between the inner pressure and the atmospheric pressure.

When the processings are started, CPU 141 firstly determines whether an execution condition of abnormality detection is established at step 2001 of FIG. 8. Specifically, when the vehicle speed SP=0 and the vehicle is idling, the execution condition of abnormality detection is established and the operation proceeds to step 2002 when such a condition is established. Further, when the condition is not established, the operation finishes the routine as it is. That is, the abnormality detection of the embodiment is carried out only when the vehicle is stationary and is idling. Further, as other execution condition of abnormality detection, a condition where water temperature of engine is at a predetermined temperature (for example, 70° C.) or higher, a condition where outside air temperature is at a predetermined temperature (for example, −10° C.) or higher, a condition where the vehicle is running at a constant speed and so on may be added.

When step 2001 is determined to be affirmative, CPU 141 proceeds to step 2002. Further, in steps 2002 through 2005, to which processing in the leakage check time period (time period between time points t1 through t6 in FIG. 12) the operation has currently proceeded is determined and the operation is shunted to respective steps in accordance with a result of the determination. During the leakage check time period, the processing stages can be determined from respective operational states of a first flag F1, a second flag F2, a third flag F3 and a negative pressure F/B flag Fx. When all of the flags F1 through F3, and Fx are cleared to "0", that is, when all of steps 2002 through 2005 are determined to be negative, CPU 141 proceeds to step 2006.

When the operation proceeds to step 2006, CPU 141 fully closes the purge control valve 123 and thereafter, fully closes the canister closure valve 120 at succeeding step 2007 and hermetically closes the section from the fuel tank 112 to the intake pipe 102. In FIG. 12, at time point t1, the purge control valve 123 is controlled to fully close by which the section from the fuel tank 112 to the purge control valve 123 is adjusted to be brought into a state the same as that of the atmospheric pressure via the atmospheric hole 119. Further, the canister closure valve 123 is controlled to fully close at time point t2 slightly retarded therefrom by which a hermetically-closed section adjusted to the atmospheric pressure is formed.

Successively, CPU 141 stores a tank inner pressure "P1'" immediately after the hermetically sealing by taking an input signal from pressure sensor 125 at step 2008 and starts to reset a timer T incorporated in ECU 140. Further, CPU 141 determines whether a predetermined time period (10 seconds in the embodiment) at a next step 2009 after having started the timer T in step 2008.

When it is before elapse of 10 seconds, the CPU 141 sets "1" to the first flag F1 at step 2010 and finishes once the routine. In FIG. 12, the first flag F1 is set at time point t2 and thereafter, step 2002 is determined to be affirmative and the processing are carried out in an order of step 2001→2002→2009→2010. During this time period, the detected value from the pressure sensor 125 gradually rises from "0 hpa" in accordance with the amount of generating fuel gas in the fuel tank 112 as shown by time points t2 through t3 of FIG. 12.

Figure 12:
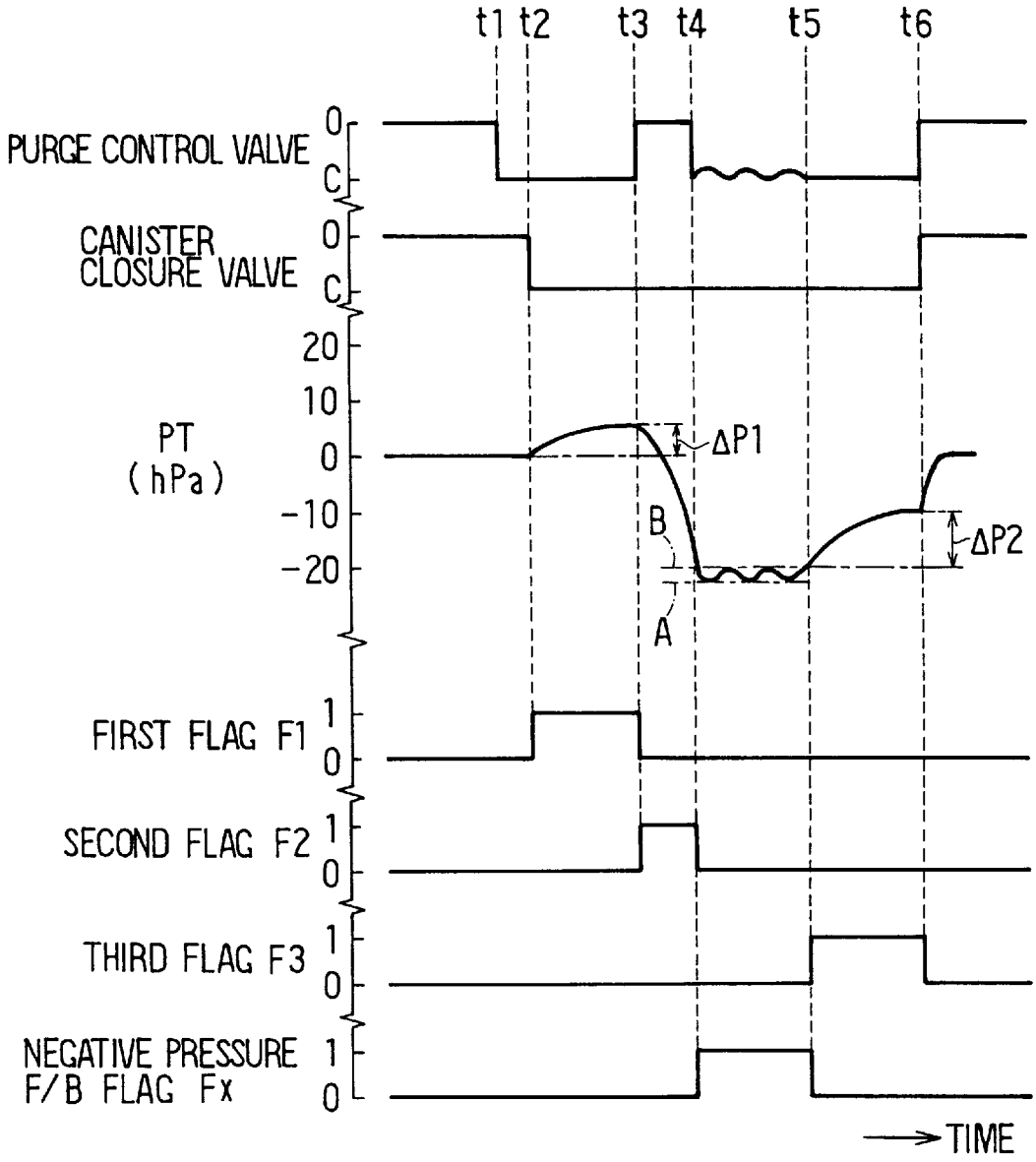
FIG. 12 illustrates time charts for explaining an execution procedure of processings of abnormality detection.

When 10 seconds has elapsed from time point t2, CPU 141 proceeds to step 2011 in FIG. 9 by affirmatively determining step 2009, takes an input signal from the pressure sensor 125, stores a tank inner pressure "P1"" and calculates the pressure change amount ΔP1 (hereinafter, referred to as change amount under atmospheric pressure) during 10 seconds after hermetically sealing the section in a succeeding step 2012 as follows.

$$\Delta P1 = P1'' - P1'$$

further, CPU 141 clears the first flag F1 to "0" at step 2013 (time point t3 of FIG. 12).

Thereafter, CPU 141 switches the purge control valve 123 form the fully closed state to the fully opened state at step 2014 and resets and starts the timer T. At time point t3 where the purge control valve 123 is switched to the fully-opened state, negative pressure at the intake pipe is introduced to the hermetically-sealed section under positive pressure until then. Therefore, when there occurs no abnormality by the closure in the purge passage portion, the detected value of the pressure sensor 125 (tank inner pressure PT) begins lowering.

Further, CPU 141 determines whether the tank inner pressure PT becomes a predetermined negative pressure level (−20 hPa according to the embodiment) or lower based on the input signal from the pressure sensor 125 at step 2015. In the case where PT>−20 hPa is determined (time period between time points t3 and t4 in FIG. 12), CPU 141 negatively determines step 2015 and proceeds to step 2016. Further, at step 2016, CPU 141 determines whether a predetermined time period (2 seconds according to the embodiment) has elapsed after starting the timer T at step 2014, that is, after time point t3 of FIG. 12.

When it is before elapse of 2 seconds, CPU 141 sets "1" to the second flag F2 at step 2017. In this way, at this occasion, step 2002 of FIG. 8 mentioned above is negatively determined and step 2003 is affirmatively determined and the processings are repeatedly carried out in an order of steps 2001 through 2003→2015→2016 . . . .

Further, when 2 seconds or more has elapsed from time point t3 while a state where step 2015 is negatively determined (state of PT>−20 hPa) is being continued, step 2016 is affirmatively determined and CPU 141 proceeds to step 2018. At step 2018, CPU 141 sets "1" to purge system closure flag Fclose signifying that a closure portion is present at somewhere in the purge system from the fuel tank 112 to the intake pipe 102 and turns on the abnormality alarming lamp 129.

That is, when there occurs no abnormality such as closure of the purge system, the tank inner pressure PT is lowered to the predetermined negative pressure level (−20 hPa) before elapse of 2 seconds during the time period of time points t3 through t4, however, when there occurs abnormality such as the purge system closure or the like, the tank inner pressure PT does not lower to the predetermined negative level even after elapse of 2 seconds and occurrence of abnormality stating the purge system closure is detected.

Meanwhile, when step 2015 is affirmatively determined, at step 2019, CPU 141 resets the second flag F2 to "0". Further, at succeeding step 2020, CPU 141 determines whether a value of a counter C for measuring a duration time period of negative pressure F/B processing, mentioned later, has reached a predetermined value K. The counter C is initially cleared to "0" and therefore, step 2020 is negatively determined and CPU 141 proceeds to step 2021.

Figure 13:
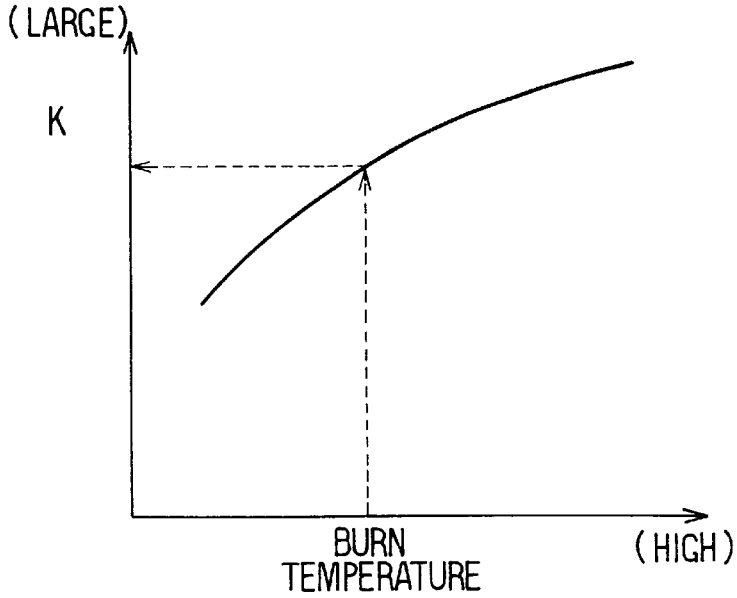
FIG. 13 is a map for setting a predetermined value K in correspondence with a duration time period for maintaining negative pressure.

Further, in this case, the predetermined value K is a variable value which is set at each time in accordance with, for example, a map of FIG. 13 and according to FIG. 13, the higher the temperature (fuel temperature) in the fuel tank 112, the larger the predetermined value K is set. Incidentally, the fuel temperature is measured by a well-known temperature sensor (illustration is omitted) and a result of the measurement is taken to ECU 140.

At step 2021, CPU 141 sets "1" to the negative pressure F/B flag Fx and carries out the negative pressure F/B processing at a succeeding step 2200. That is, the negative F/B processing is started at time point t4 of FIG. 12 and according to the processing, the tank inner pressure PT is controlled by a feedback control to a vicinity of "−20 hPa" during a predetermined time period. Accordingly, at and after time point t4, steps 2002 and 2003 of FIG. 8 are negatively determined and step 2004 is affirmatively determined and the processings are repeatedly executed in an order of steps 2001 through 2004→2020→2021→2200.

Figure 11:
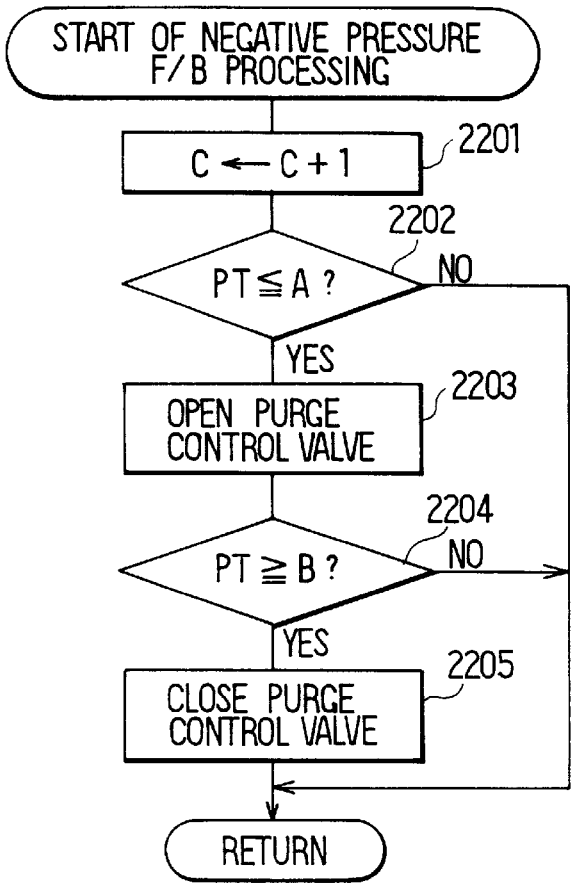
FIG. 11 is a flowchart showing negative pressure F/B (feedback) processings.

At this point, an explanation will be given of the negative pressure F/B processing carried out at step 2200 in reference to FIG. 11. In FIG. 11, at step 2201, CPU 141 increments the counter C by "1" and at a succeeding step 2202, CPU 141 determines whether the tank inner pressure PT has reached value A which is slightly on the negative pressure side of −20 hPa. Further, at step 2203, under a condition of PT≦A (YES at step 2202), CPU 141 controls the opening degree of the purge control valve to the opening side at step 2203. Specifically, CPU 141 increases the control duty ratio of the purge control value 123 by about several %.

Further, at step 2204, CPU 141 determines whether the tank inner pressure PT has reached a value B which is slightly on the positive pressure side of −20 hPa. Further, at step 2205, under a condition of PT≧B (YES at step 2204), CPU 141 controls the opening degree of the purge control valve 123 to the closing side at step 2205. Specifically, CPU 141 reduces the control duty ratio of the purge control valve 123 by about several %. After the processings of FIG. 11, CPU 141 returns to the original abnormality detection processings.

Further, when step 2020 is affirmatively determined in accordance with the counting operation of the counter C by the processings in FIG. 11, CPU 141 proceeds to step 2022 and clears the negative pressure F/B flag Fx to "0". Further, at a succeeding step 2023, the counter C is cleared to "0".

Figure 10:
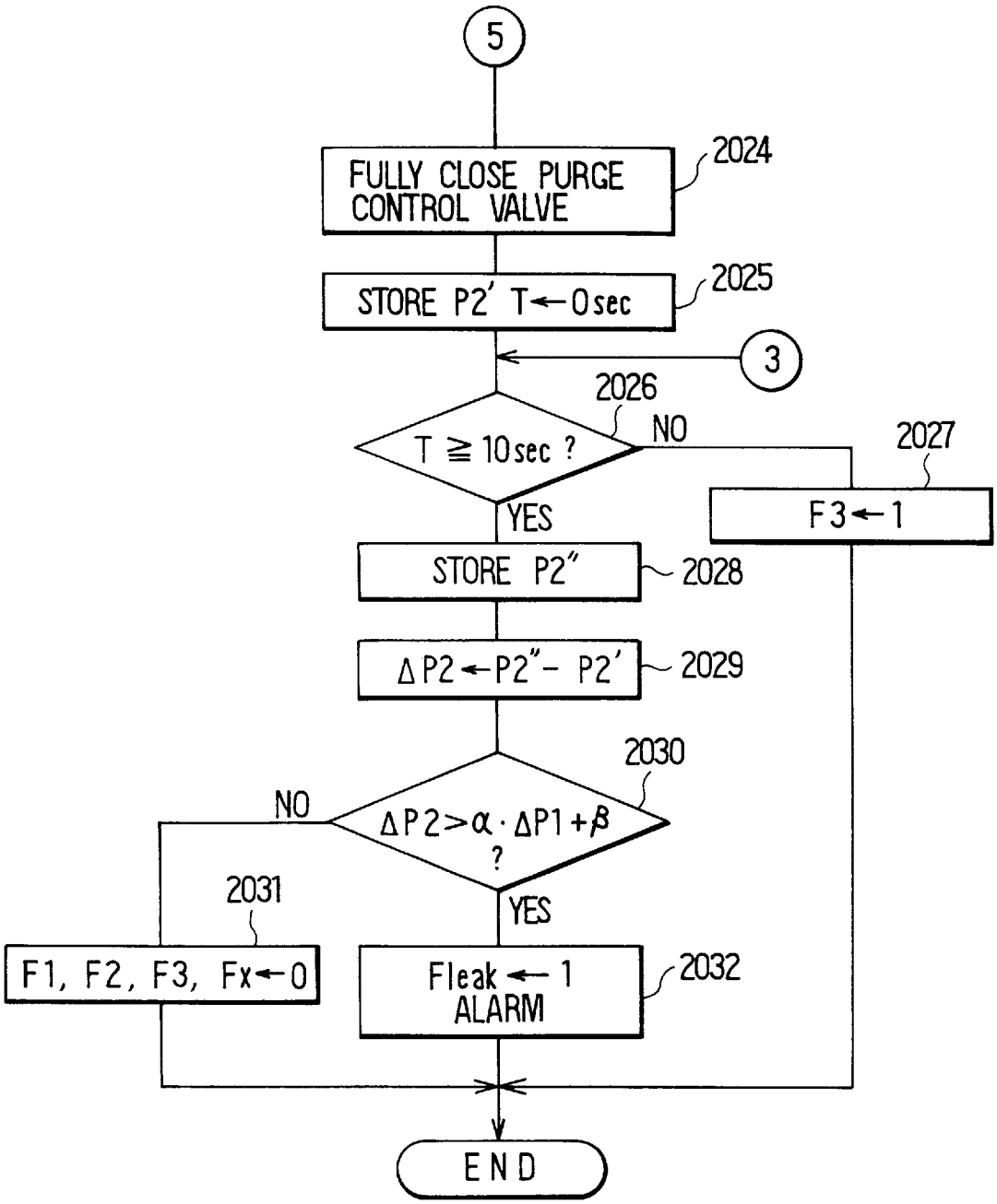
FIG. 10 is a flowchart showing processings of abnormality detection in continuation to FIG. 8 and FIG. 9.

Thereafter, CPU 141 controls to fully open the purge control valve 123 again at step 2024 of FIG. 10. Further, CPU 141 takes the input signal from the pressure sensor 125 at step 2025, stores the tank inner pressure "P2'" immediately after the hermetically-sealed section is brought into the negative pressure hermetically-sealed state under negative pressure and resets and starts a timer T incorporated in ECU 140. This timing corresponds to time point t5 of FIG. 12.

In sum, at time point t5 of FIG. 12, the hermetically-sealed section is adjusted to a negative pressure state of −20 hPa and thereafter, during the time period of time points t5 through t6, the tank inner pressure PT gradually rises from the vicinity of −20 hPa in accordance with an amount of generating fuel gas in the fuel tank 112.

Next, at step 2026, CPU 141 determines whether a predetermined time period (10 seconds according to the embodiment) has elapsed after starting the timer T at step 2025, that is, after time point t5 of FIG. 12. When it is before elapse of 10 seconds, CPU 141 sets "1" to the third flag F3 at step 2027. In this way, at this occasion, steps 2002 through 2004 are negatively determined and step 2005 is affirmatively determined and processings are repeatedly carried out in an order of steps 2001 through 2005→2026→2027.

When 10 seconds has elapsed from time point t5, CPU 141 affirmatively determines step 2026 and proceeds to step 2028. At step 2028, CPU 141 takes the input signal from the pressure sensor 125, stores the tank inner pressure "P2"" at time point t6 and calculates the pressure change amount (hereinafter, referred to as change amount under negative pressure) ΔP2 during 10 seconds after the section has been hermetically sealed under the negative pressure state at a succeeding step 2029 as follows.

$$\Delta P2 = P2'' - P2'$$

Thereafter, CPU 141 determines whether there occurs leakage on the basis of a predetermined leakage determining condition at step 2030. Specifically, when the following equation is established, CPU 141 determines to state "occurrence of leakage".

$$\Delta P2 > \alpha \cdot \Delta P1 + \beta$$

where notation α designates a coefficient for correcting a difference in a fuel evaporation amount caused by a difference between the atmospheric pressure and the negative pressure and notation β designates a coefficient for correcting accuracy of the pressure sensor, leakage at the canister closure valve 120 and so on.

That is, when there is a cause of leakage at the hermetically-sealed section from the fuel tank 112 to the purge control valve 123, under a state of positive pressure, gas flows out from the hermetically-sealed section to the atmosphere whereas under a state of negative pressure, air flows in from the atmosphere to the hermetically-sealed section. Accordingly, "change amount ΔP2 under negative pressure" becomes larger than "change amount ΔP1 under atmospheric pressure". Further, in this description, the change amount ΔP1 under the atmospheric pressure corresponds to "an amount of generating fuel gas in the fuel tank 12−an amount of gas flowing out from the hermetically-sealed section to the atmosphere";

the change amount ΔP2 under the negative pressure corresponds to "the amount of generating fuel gas in the fuel tank 12+an amount of air flowing into the hermetically-sealed section". From these reasoning, the leakage determining condition of the inequality mentioned above is derived.

When the leakage determining condition of the inequality is not established, that is, when step 2030 is negatively determined, CPU 141 proceeds to step 2031 and forcibly clears the respective first through third flags F1 through F3 as well as the negative pressure F/B flag Fx by which the routine is finished.

Further, when the leakage determining condition of the inequality is established, that is, when step 2030 is affirmatively determined, CPU 141 proceeds to step 2032. Further, CPU 141 sets "1" to a purge system leakage flag Fleak signifying that there is a portion causing leakage at somewhere in the purge system from the fuel tank 112 to the intake pipe 102 and turns on the abnormality alarming light 129 and thereafter finishes the subroutine.

According to the processings explained above, in the case where leakage or closure occurs in the section from the fuel tank 112 to the purge control valve 123 in the fuel gas emission preventing device, the occurrence can always be detected precisely. Further, the abnormality detection can be carried out regardless of the position of attaching the pressure sensor 125.

Further, according to the embodiment, the control of opening and closing the purge control valve 123 and the canister closure valve 120 in FIG. 8 through FIG. 10 corresponds to pressure adjusting means specified in claims and step 2030 of FIG. 10 corresponds to abnormality detecting means. Further, step 2200 of FIG. 9 (processings of FIG. 11) corresponds to negative pressure maintaining means and operation of the negative pressure F/B flag Fx in FIG. 8 through FIG. 10 corresponds to abnormality detection start permitting means.

According to the embodiment which has been described above in details, particular effects shown below are achieved.

(a) According to the embodiment, immediately after adjusting pressure at negative pressure level, the negative pressure level at the occasion is maintained at a vicinity thereof for a predetermined time period and after maintaining the negative pressure for the predetermined time period, detection of pressure state for detecting abnormality is started. Under such a constitution, the abnormality determination is carried out after abrupt occurrence of fuel gas has been converged and accordingly, there causes no unprepared pressure change by generating an unexpectedly large amount of fuel gas and the leakage determination can be carried out with high accuracy from a change in the pressure state. As a result, even when fuel gas is leaked by a very small hole, the abnormality can be detected accurately.

Figure 14A:
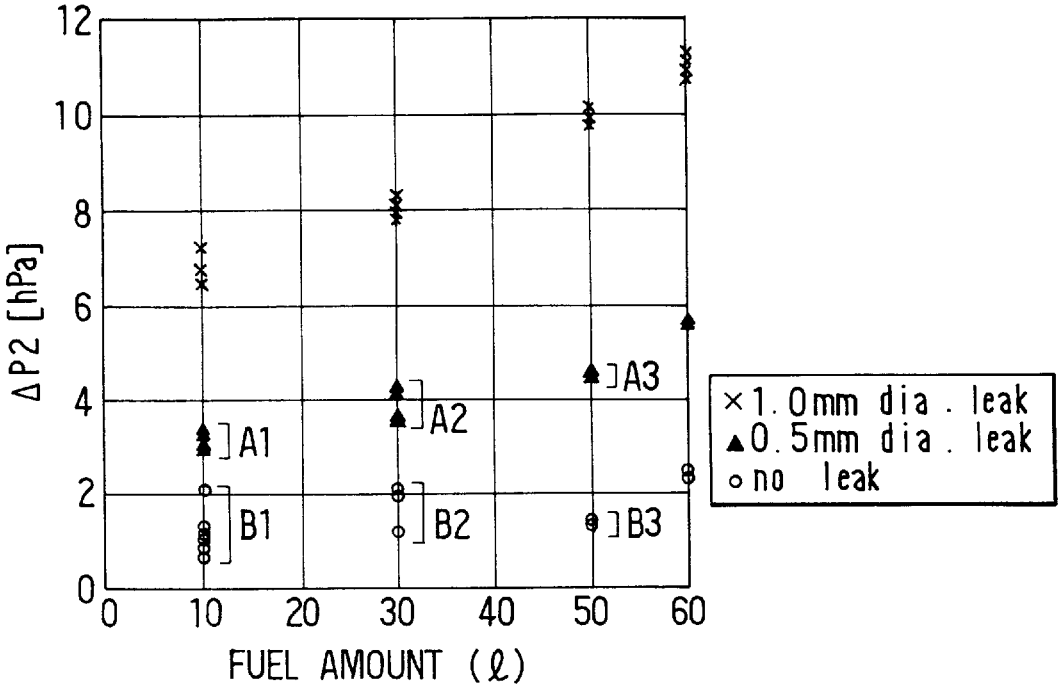
FIGS. 14A and 14B are graphs for explaining an effect in the second embodiment.
Figure 14B:
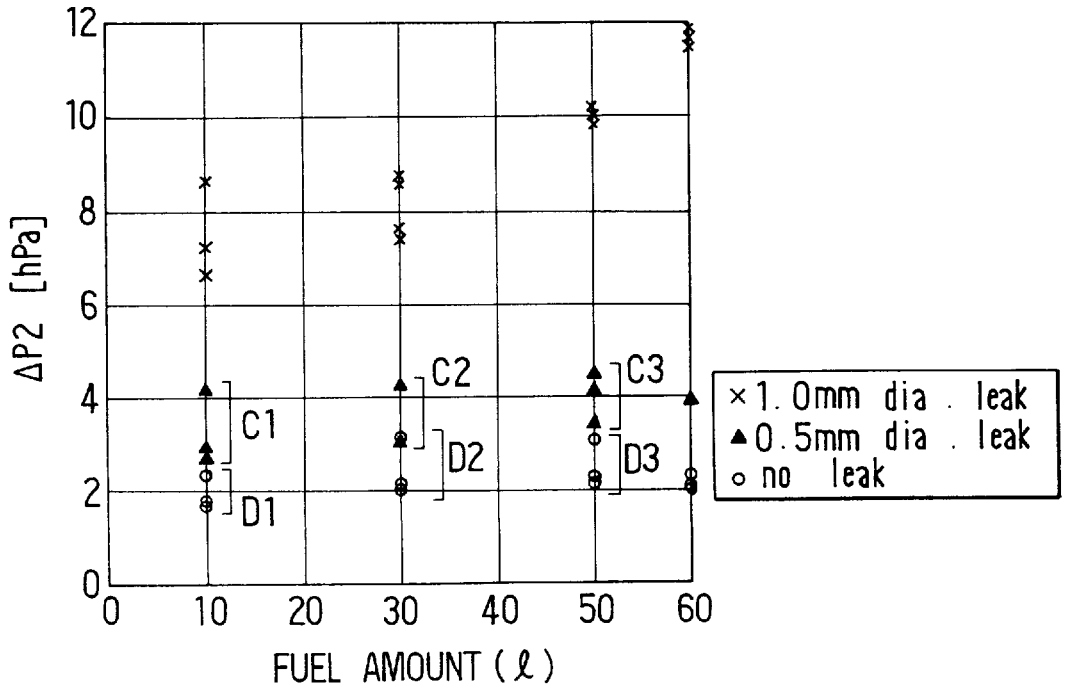

FIGS. 14A and 14B are diagrams for confirming the effect of the embodiment in which the ordinate of each of the diagrams indicates the change amount ΔP2 under negative pressure and the abscissa designates the fuel amount in the fuel tank 112. Further, the diagram 14A shows an experimental result in the apparatus of the embodiment and FIG. 14B shows an experimental result in the conventional apparatus (apparatus which is not maintained under negative pressure) and in the respective diagrams;

"×" mark designates data in the case of leakage of ϕ1.0 mm,

"▲" mark designates data in the case of leakage of ϕ0.5 mm,

"○" mark designates data in the case of no leakage, respectively.

Observing data of the respective marks, data of "×"mark can clearly be differentiated from other data, however, data of "▲" mark and "○" mark are scattered in ranges of A1 through A3 and B1 through B3 of FIG. 14A and C1 through C3 and D1 through D3 of FIG. 14B, particularly, in the case of FIG. 14B, the ranges C1 through C3 and the ranges D1 through D3 may overlap each other and it is very difficult to differentiate the both data from each other. In contrast thereto, in the case of FIG. 14A, the ranges A1 through A3 and the ranges B1 through B3 can be differentiated from each other, leakage of very small hole (ϕ0.5 mm) and no leakage can clearly be differentiated from each other.

(b) Further, according to the embodiment, the pressure in the hermetically-sealed section is maintained at the predetermined negative pressure level by controlling the opening degree of the purge control valve 123 between the canister 116 and the intake pipe 102 by duty control. According to the constitution, maintaining the negative pressure in the hermetically-sealed section can be carried out properly.

(c) A time period for maintaining the section at the predetermined negative pressure level is variably set in accordance with the fuel temperature in the fuel tank 112 (refer to map of FIG. 13). In this case, proper control for maintaining the negative pressure can be realized while corresponding to the degree of generation of fuel gas.

(d) When the section from the fuel tank 112 to the intake pipe 102 is hermetically sealed, the atmospheric pressure (first predetermined pressure) and −20 hPa (second predetermined pressure) are switched and abnormality of leakage or the like is detected from the result of comparing the pressure change states at the respective pressures. In such a case when it is assumed that the cause of leakage is present, the rate of leakage is changed in accordance with a difference in pressure difference relative to the atmospheric pressure in adjusting the respective pressures. Accordingly, presence or absence of leakage or cause of leakage can easily be detected in accordance with the difference between two pressure change states mentioned above.

Further, embodiments of the present invention can be realized in ways other than the above-described by the following embodiments.

Although according to the embodiment mentioned above, the predetermined value K in correspondence with the negative pressure maintaining time period is set variably in accordance with fuel temperature in accordance with the relationship of FIG. 13, the constitution is changed in accordance with the following items I through III.

Figure 15:
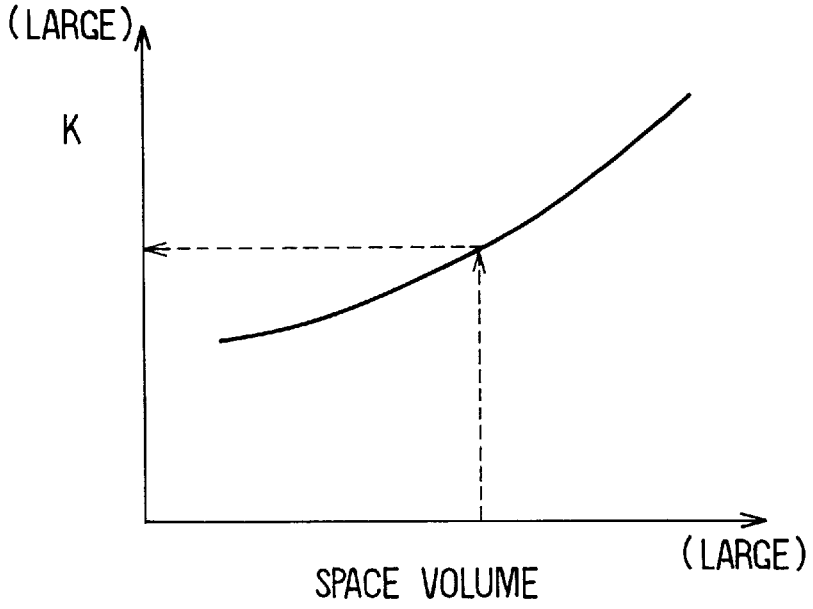
FIG. 15 is a map for setting a predetermined value K in correspondence with a time period for maintaining negative pressure in accordance with a space volume of a fuel tank.

I. The predetermined value K is set variably in accordance with a parameter concerning a space volume of the fuel tank 112. In this case, as shown by FIG. 15, the larger the space volume of the fuel tank 112, the larger the predetermined value K is preferably set. Incidentally, the space volume is calculated on the basis of a result for measuring a fuel level gage attached to the fuel tank 112 and the larger the remaining amount of fuel measured by the level gage, the smaller the space volume and the smaller the remaining amount of fuel, the larger the space volume.

Figure 16:
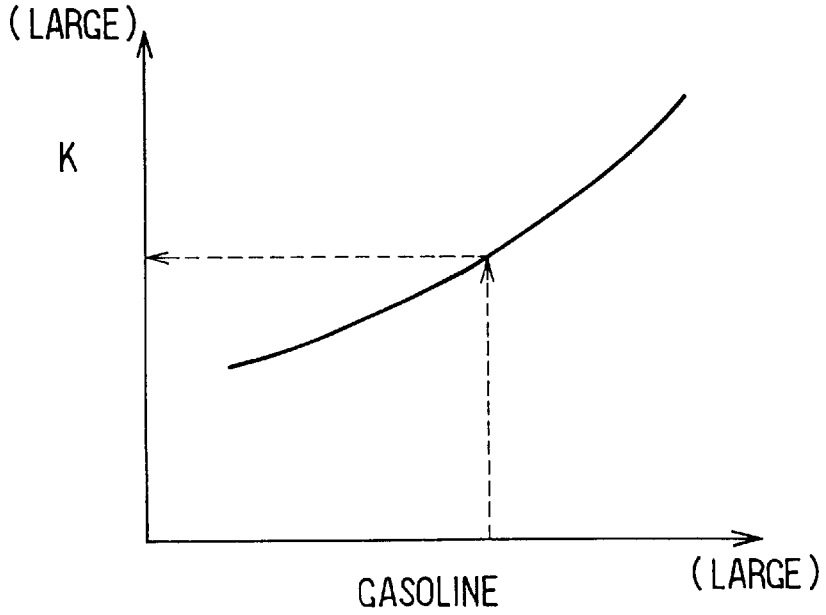
FIG. 16 is a map for setting a predetermined value K in correspondence with a time period for maintaining negative pressure in accordance with gasoline RVP.
Figure 17:
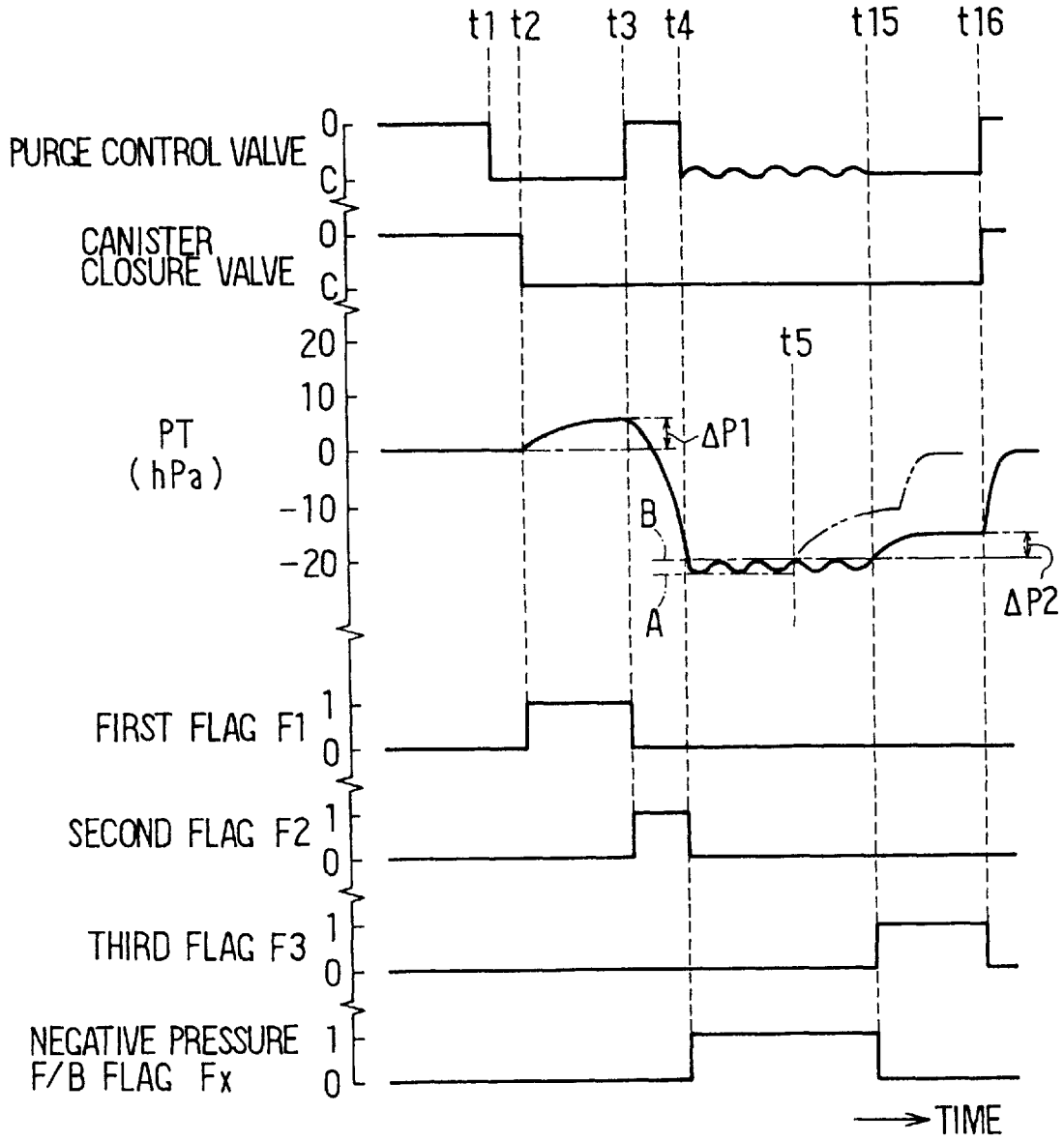
FIG. 17 illustrates time charts for explaining an execution procedure of processings of abnormality detection.

When it is assumed that the space volume is large, that is, the remaining amount of fuel is small, a large value is set to predetermined value K in reference to the map of FIG. 15. Thereby, as shown by FIG. 17, the time period where the negative pressure F/B is continued is set to a comparatively long time period (time points t4 through t15). Further, thereafter, at time point t16, the change amount ΔP2 under negative pressure is calculated and the abnormality detection is carried out from the value of ΔP2. When the duration time of the negative pressure F/B is prolonged from "t4 through t15", designated by the two-dotted chain line to "t4 through t15", the change amount ΔP2 under negative pressure is measured under a state where generation of fuel evaporated gas is further stabilized. Therefore, the influence of the fuel evaporated gas is reduced and detection of leakage can be carried out with high reliability. II. The predetermined value K is set variably in accordance with properties of fuel. In this case, as shown by FIG. 16, the larger the Reed Vapor Pressure (RVP) of gasoline fuel, the larger the predetermined value K is preferably set. Incidentally, the Reed Vapor Pressure is calculated based on a result of measuring by gasoline property sensor attached to the fuel tank 112 or the like.

III. The predetermined value K is set variably in accordance with pressure gradient or required time period when negative pressure is introduced. Specifically, a required time period (time period between time points t3 through t4 of FIG. 12) in changing the tank inner pressure PT to the predetermined negative pressure value (−20 hPa) during the leakage check time period of FIG. 12, is calculated and the predetermined value K is set in accordance with the required time period. In this case, the longer the required time period to the predetermined negative pressure, the larger the amount of generation of fuel gas per unit time and accordingly, the larger the predetermined value. Or, when the negative pressure is changed (time points t3 through t4 of FIG. 12) similarly in the leakage check time period, the pressure gradient in this case is calculated, and the predetermined value K is set in accordance with the pressure gradient. At this occasion, the smaller the pressure gradient, the larger the amount of generating fuel gas per time and accordingly, the larger the predetermined value K is set.

According to the respective constitutions of I, II and III, control of maintaining pertinent negative pressure can be realized while corresponding to the degree of generating fuel gas. Further, fuel temperature, space volume in tank (remaining fuel amount), fuel properties, pressure gradient in introducing negative pressure and so on can be used in a combined manner and the predetermined value K can be calculated from the plurality of factors and by using the plurality of factors, the reliability of the abnormality detection is promoted. Meanwhile, the predetermined value K can also be specified as the fixed value.

Although according to the embodiments mentioned above, in the abnormality detection processings carried out in accordance with flowcharts of FIG. 8 through FIG. 10, after measuring the pressure change state at a vicinity of the atmospheric pressure, the pressure change state under negative pressure is measured, the order may be reversed.

Time periods of pressure adjustment (time periods of time points t2 through t3, t3 through t4, t5 through t6 in FIG. 12) are not limited to the time periods mentioned above but may be specified by pertinently changing them in accordance with the specification of an engine or the like.

Further, although according to the embodiments mentioned above, abnormality detection is carried out by comparing the pressure change amount (ΔP1) at a vicinity of the atmospheric pressure with the pressure change amount (ΔP2) in the negative pressure region, the pressure change amount is detected at least in the negative pressure region and the abnormality detection is carried out only by the pressure change amount. In this case, determination of normality/abnormality is carried out from the pressure change amount at the negative pressure region by using determinants previously set by experiment of the like. Also according to the constitution, the negative pressure level is maintained for a predetermined time period in adjusting pressure in the negative pressure region and thereafter, detection of pressure state for abnormality detection is started by which similar to the embodiments mentioned above, there is achieved an excellent effect where abnormality can accurately be detected even in leaking fuel gas through a very small hole or the like.

Although according to the embodiments mentioned above, the pressure sensor 125 as pressure detecting means is installed at the fuel tank 112, for example, the pressure sensor 125 may be installed at a section between the canister 116 and the intake pipe 102. Also in this case, determination of leakage of entire hermetically-sealed section can be carried out based on the pressure change state after constituting the hermetically-sealed section.

(Third Embodiment)

The basic constitution of the third embodiment is similar to that of the second embodiment mentioned above and accordingly, an explanation thereof will be omitted.

An explanation will be given of abnormality detecting processings of a fuel gas emission preventing device according to the third embodiment among various operation processings executed by CPU 141 in ECU 140 in reference to flowcharts of FIG. 18 through FIG. 21 and time charts of FIG. 12. According to the processings of FIG. 18 and FIG. 19, when an ignition key switch, not illustrated, is turned on, the processings are repeatedly executed at it every predetermined time (for example, at every 64 milliseconds) along with the fuel injection control processing. Further, in the time charts of FIG. 22, a time period indicated by time points t1 through t5 corresponds to a time period for detecting abnormality such as leakage of fuel gas of the fuel gas emission preventing device (hereinafter, referred to as leakage check time period for convenience). However, the tank inner pressure PT designates a difference between the tank inner pressure and the atmospheric pressure.

When the processing is started, CPU 141 firstly determines whether an execution condition of abnormality detection is established at step 3001. In this case, according to the embodiment, whether an abnormality detection suspension flag Fn which is operated by a processing of FIG. 21 (leakage determining processing) mentioned later is "0", is determined. The abnormality detection suspension flag Fn indicates whether abnormality detection at step 102 and steps thereafter are suspended or permitted where Fn=1 represents suspension of abnormality detection and Fn=0 represents permit of abnormality detection. Further, as other execution condition of abnormality detection, a condition where water temperature of engine is equal to or higher than a predetermined temperature (for example, 70+ C.), a condition where outside air temperature is equal to or higher than a predetermined temperature (for example, −10° C.), a condition where the vehicle is running at a constant speed and so on, may be added.

When step 3001 is negatively determined (case of Fn=1), CPU 141 finishes the routine as it is. That is, abnormality detection at step 3002 and steps thereafter is not executed.

Further, when step 3001 is affirmatively determined (case of Fn=0), CPU 141 proceeds to step 3002. Further, to which processing the operation has proceeded during the leakage check time period (time period of time points t1 through t5 of FIG. 22), is determined in steps 3002 through 3004 and the operation is shunted to respective steps in accordance with a result of the determination. The step of the processing can be determined from respective operational states of the first flag F1, the second flag F2 and the third flag F3 during the leakage check time period. When all of the flags F1 through F3 are cleared to "0", that is, when all of steps 3002 through 3004 are negatively determined, the operation proceeds to step 3005.

Figure 22:
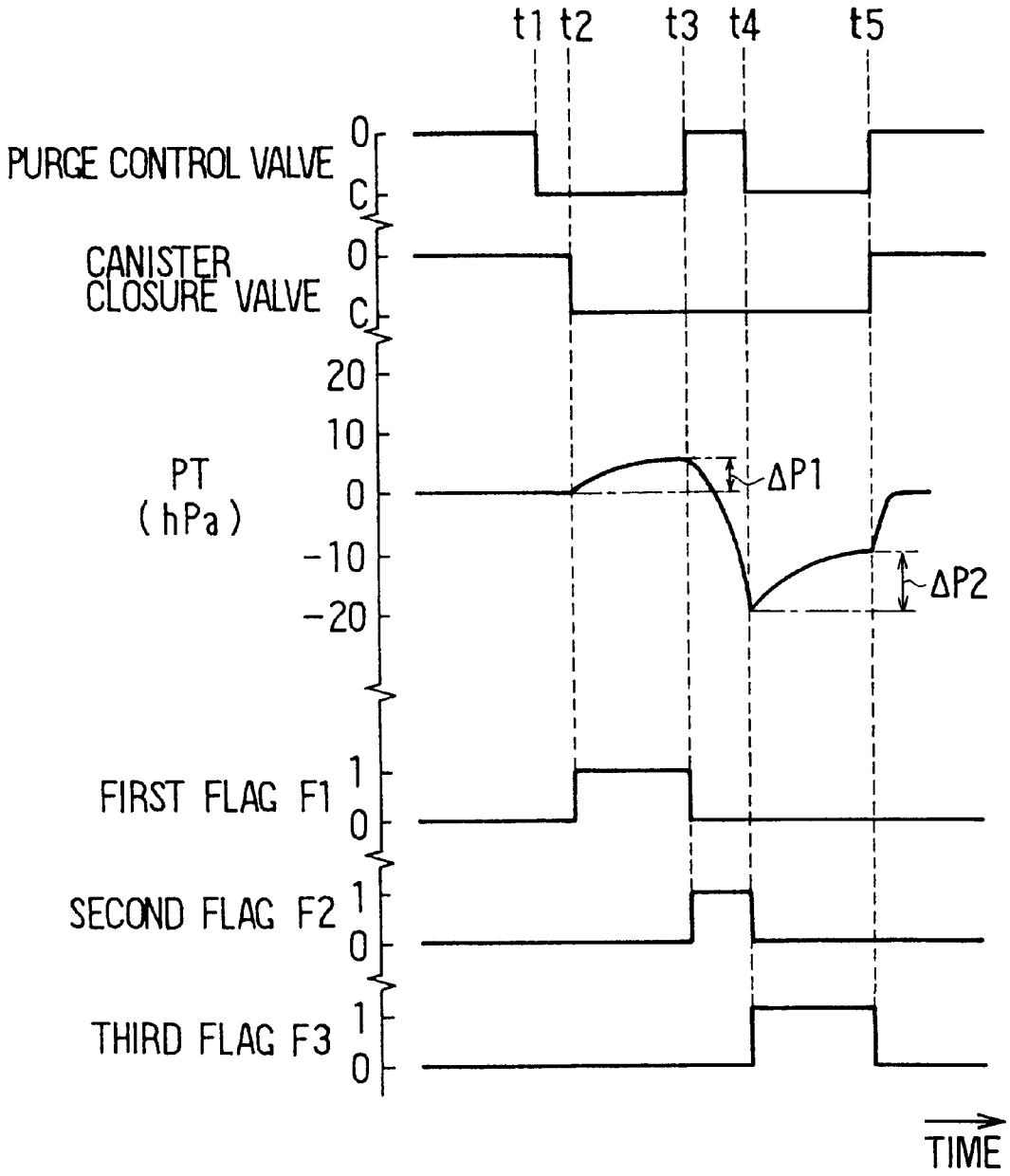
FIG. 22 illustrates time charts for explaining an execution procedure of processings of abnormality detection.

When the operation proceeds to step 3005, CPU 141 fully closes the purge control valve 123 and thereafter, fully closes the canister closure valve 120 at succeeding step 3006 by which the section from the fuel tank 1122 to the intake pipe 102 is hermetically sealed. In FIG. 22, at time point t1, the purge control valve 123 is controlled to fully close by which the section of from the fuel tank 112 to the purge control valve 123 is adjusted to a state the same as the state of the atmospheric pressure via the atmospheric hole 119. Further, the canister closure valve 123 is controlled to fully close at time point t2 which is slightly retarded from t1 by which the hermetically-sealed section adjusted to the atmospheric pressure is formed.

Successively, CPU 141 takes the input signal from the pressure sensor 125, stores the tank inner pressure "P1'" immediately after the hermetical sealing and resets and starts the timer T incorporated in CPU 140 at step 3007. Further, at succeeding step 3008, CPU 141 determines whether a predetermined time period (10 seconds according to the embodiment) has elapsed after starting the timer T at step 3007.

When it is before elapse of 10 seconds, at step 3009, CPU 141 sets "1" to the first flag F1 and finishes once the routine. In FIG. 22, the first flag F1 is set at time point t2, thereafter, step 3002 is affirmatively determined and the processings are carried out in an order of steps 3001→3002→3008→3009. During this time period, as indicated at time points t2 through t3 of FIG. 22, the detected value of the pressure sensor 125 gradually rises from "0 hPa" in accordance with an amount of generating fuel gas in the fuel tank 112.

When 10 seconds has elapsed from time point t2, CPU 141 affirmatively determines step 3008, proceeds to step 3010 of FIG. 19, takes the input signal from the pressure sensor 125, stores the tank inner pressure "P1"" at this moment, and calculates the pressure change amount ΔP1 (hereinafter, referred to as change amount under atmospheric pressure) during 10 seconds after hermetically sealing the section at a succeeding step 3011 by the following equation.

$$\Delta P1 = P1'' - P1'$$

Further, CPU 141 clears the first flag F1 to "0" at step 3012 (time point t3 of FIG. 22).

Thereafter, at step 3013, CPU 141 switches the purge control valve 123 from a fully closed state to a fully opened state and resets and starts the timer T. At time point t3 where the purge control valve 123 is switched to the fully opened state, the negative pressure of the intake pipe is introduced to the hermetically-sealed section which has been under a state of positive pressure. Accordingly, the detected value (tank inner pressure PT) of the pressure sensor 125 begin lowering when no abnormality by closure occurs at the purge passage portion.

Further, CPU 141 determines whether the tank inner pressure PT is equal to or lower than a predetermined negative pressure level (−20 hPa according to the embodiment). In the case where PT>−20 hPa is determined (time periods of time points t3 through t4 of FIG. 22), CPU 141 negatively determines step 3014 and proceeds to step 3015. Further, at step 3015, CPU 141 determines whether a predetermined time period (2 seconds according to the embodiment) has elapsed after starting the timer T at step 3013, that is, after time point t3 of FIG. 22.

Figure 18:
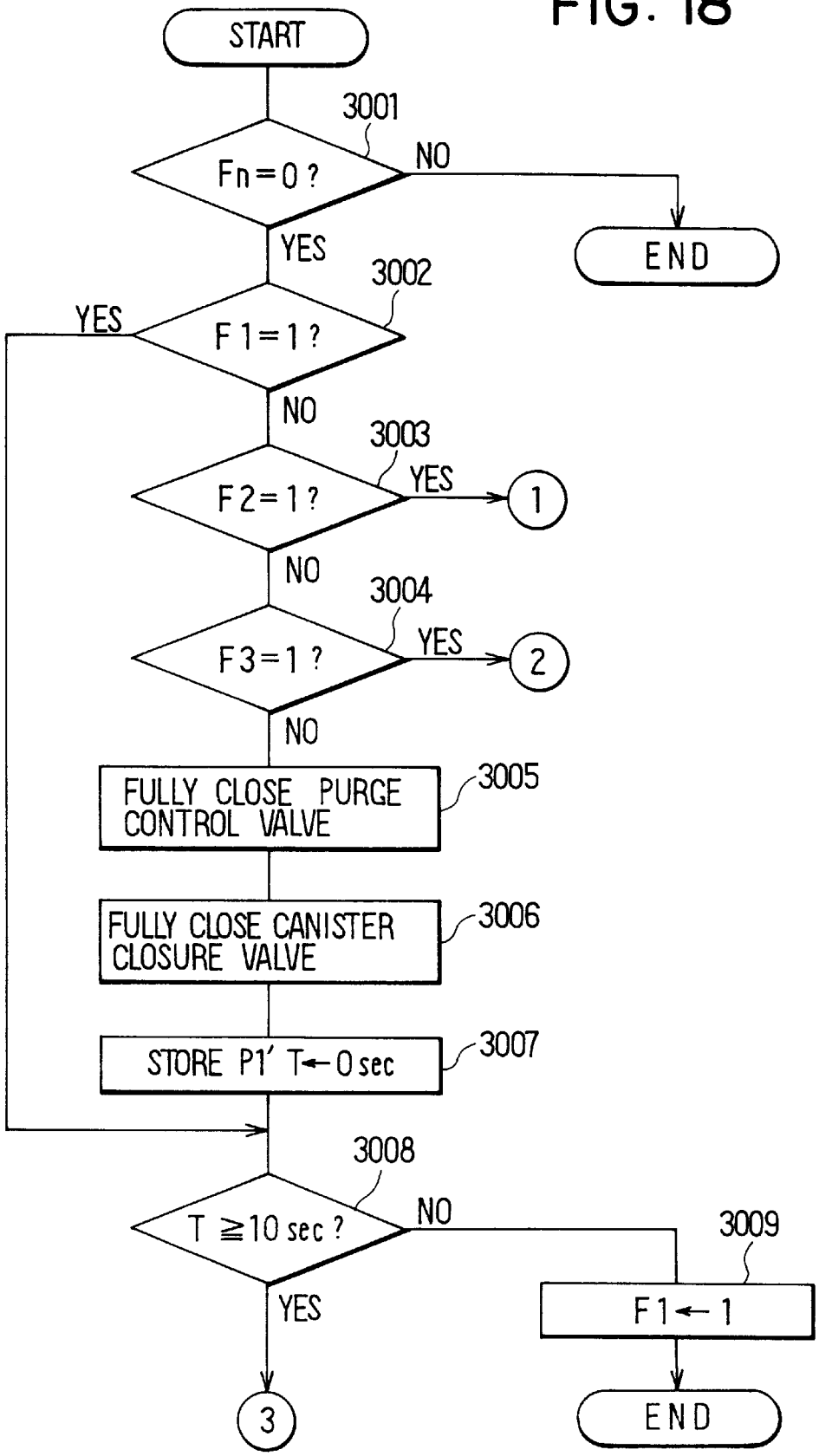
FIG. 18 is a flowchart showing processings of abnormality detection.

When it is before elapse of 2 seconds at step 3016, CPU 141 sets "1" to the second flag F2. In this way, in this occasion, step 3002 of FIG. 18 is negatively is determined and step 3003 is affirmatively determined and processings are repeatedly executed in an order of steps 3001 through 3003→3014→3015 . . . .

Further, when 2 seconds or more has elapsed from time point t3 while a state where step 3014 is negatively determined (state of PT>−20 hPa) is being continued, step 3015 is affirmatively determined and CPU 141 proceeds to step 3017. At step 3017, CPU 141 sets "1" to a purge system closure flag Fclose signifying that there is a closure portion at somewhere in the purge system from the fuel tank 112 to the intake pipe 102 and turns on the abnormality alarming light 129.

That is, when abnormality such as purge system closure or the like does not occur, the tank inner pressure PT is lowered to the predetermined negative pressure level (−20 hPa) before elapse of 2 seconds in the time period of time points t3 through t4, however, when abnormality such as purge system closure occurs, the tank inner pressure PT is not lowered to the predetermined negative pressure level even after elapse of 2 seconds and abnormality occurrence stating the purge system closure is detected.

Meanwhile, when step 3014 is affirmatively determined, CPU 141 resets the second flag F2 to "0" at step 3018 and controls to fully close the purge control valve 123 again at a succeeding step 3019. Further, at step 3020, CPU 141 takes the input signal from the pressure sensor 125, stores the tank inner pressure "P2'" immediately after bringing the hermetically-sealed section to the hermetically-sealed state under negative pressure and resets and starts the timer T incorporated in ECU 140. The timing corresponds to time point t4 of FIG. 22.

In sum, at time point t4 of FIG. 22, the hermetically-sealed section is adjusted to the state under negative pressure of −20 hPa, thereafter, during the time period of time points t4 through t5, the tank inner pressure PT gradually rises from −20 hPa in accordance with an amount of generating fuel gas in the fuel tank 112.

Next, at step 3021, CPU 141 determines whether a predetermined time period (10 seconds according to the embodiment) has elapsed after starting the timer T at step 3020, that is, after time point t4 of FIG. 22. When it is before elapse of 10 seconds, CPU 141 sets "1" to the third flag F3 at step 3022 and carries out fuel rock detection processing at succeeding step 3200. Further, a description will be given later of details of the fuel rock detection processing which is carried out during the time period of time points t4 through t5 in reference to a flowchart of FIG. 20. In this way, at this occasion, steps 3002 and 3003 of FIG. 18 are negatively determined and step 3004 is affirmatively determined and processings are repeatedly executed in an order of steps 3001 through 3004→3021→3022→3200.

When 10 seconds has elapsed from time point t4, CPU 141 affirmatively determines step 3021 and proceeds to step 3023. At step 3023, CPU 141 takes the input signal from the pressure sensor 125, stores the tank inner pressure "P2"" at time point t5 and calculates the pressure change amount ΔP2 (hereinafter, referred to as change amount under negative pressure) during 10 seconds after hermetically sealing the section under the negative pressure state at succeeding step 3024 by the following equation.

$$\Delta P2=P2''-P2'$$

Further, CPU 141 carries out leakage determining processing at step 3300 and thereafter finishes once the routine. Further, a description will be given of details of the leakage determining processing which is carried out at time point t5 of FIG. 22 in reference to a flowchart of FIG. 21.

Next, an explanation will be given of a subroutine of the fuel rock detection processing which is carried out at step 3200 of FIG. 19 in reference to the flowchart of FIG. 20. The fuel rock detection processing is repeatedly executed at the time period of time points t4 through t5 of FIG. 22 as has been described already, that is, a time period where both of the purge control valve 123 and the canister closure valve 120 are fully closed and the tank inner pressure PT is under the negative pressure state.

Figure 20:
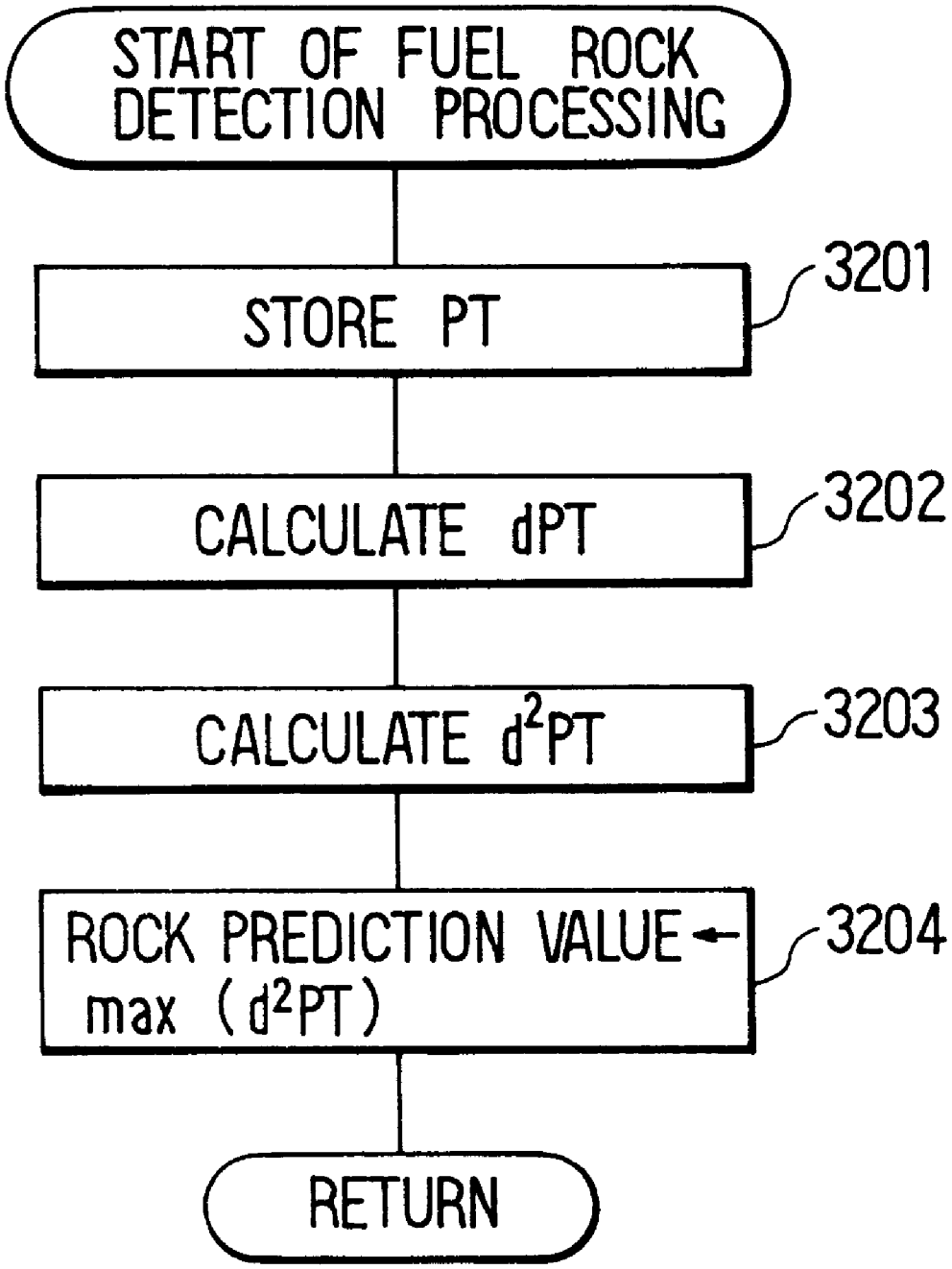
FIG. 20 is a flowchart showing processings of detecting fuel rocking.

When the processing of FIG. 20 is started, at step 3201, CPU 141 firstly reads the tank inner pressure PT in correspondence with the input signal from the pressure sensor 125. The read tank inner pressure PT may be a flattened value. Next, CPU 141 calculates an amount of change dPT1 in the tank inner pressure at step 3202. In this processing, the tank inner pressure change amount dPT1 is calculated by the following equation.

$$dPT=PT(i)-PT(i-1)$$

where "i" designates a number of times of sampling.

Thereafter, at step 3203, CPU 141 calculates a change amount of the tank inner pressure change amount dPT1 (hereinafter, referred to as twice change amount d^2PT). In this processing, the twice change amount d^2PT is calculated by the following equation $$d^2PT=dPT(i)-dPT(i-1).$$

Further, CPU 141 stores a maximum value of the twice change amount d^2PT until then as "rock prediction value" at step 3204. In sum, during the time period of time points t4 through t5, twice change amount d^2PT of the tank inner pressure PT is successively calculated and the maximum value is updated at each time as the rock prediction value. In this case, the twice change amount d^2PT of the tank inner pressure PT is calculated and stored as data reflecting a degree of rocking fuel in the fuel tank 112.

Next, an explanation will be given of a subroutine of the leakage determining processing which is carried out at step 3300 of FIG. 19 in reference to the flowcharts of FIG. 21. The leakage determining processing is carried out at time point t5 of FIG. 22 as has been described already.

Figure 21:
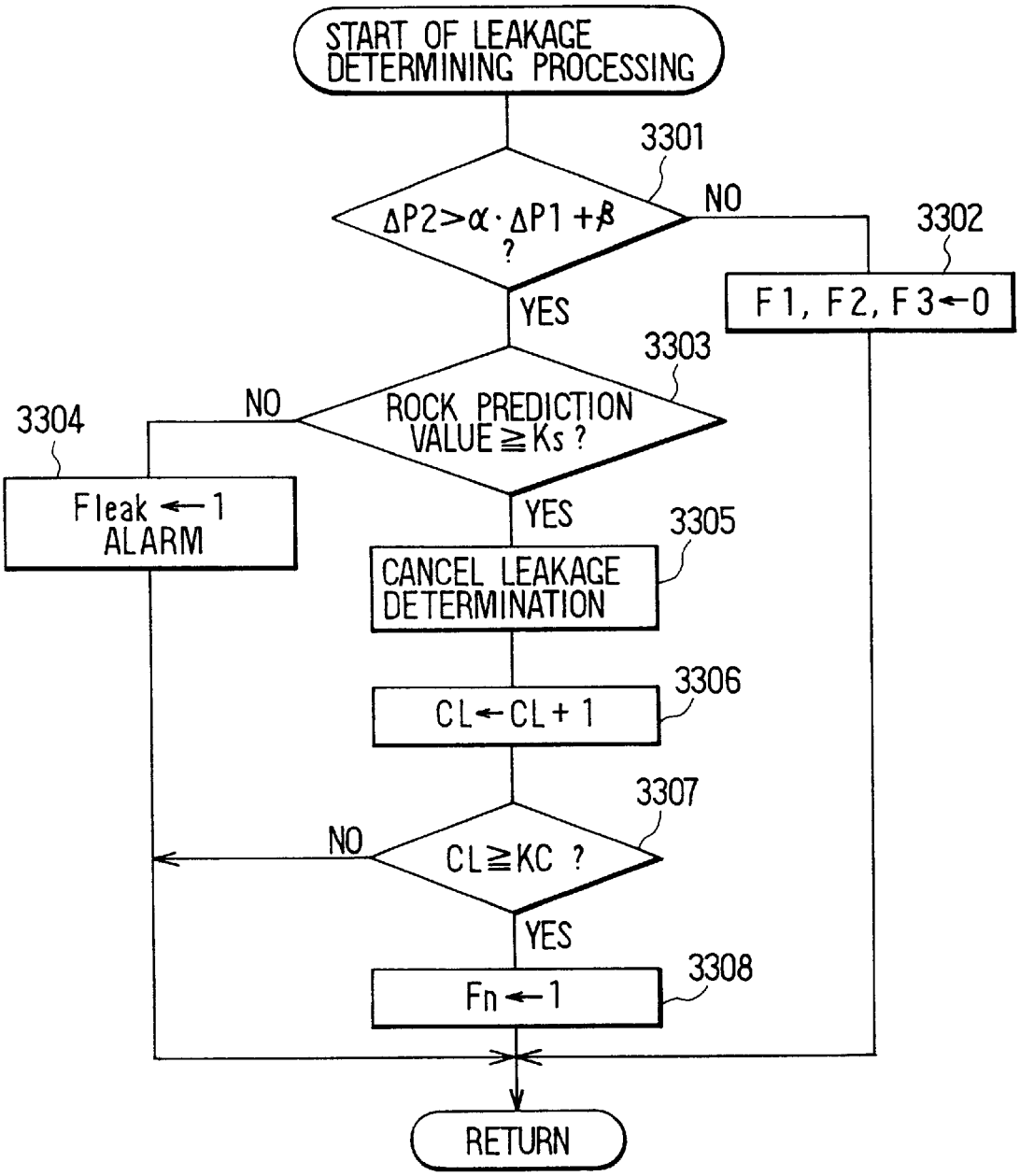
FIG. 21 is a flowchart showing processings of leakage determination.

When the processing of FIG. 21 is started, at step 3301, CPU 141 determines whether there occurs leakage based on the predetermined leakage determining condition. Specifically, "occurrence of leakage" is determined when the following equation is established.

$$\Delta P2>\alpha\cdot\Delta P1+\beta$$

where notation α designates a coefficient for correcting a difference in a fuel evaporation amount caused by a difference between the atmospheric pressure and the negative pressure and notation β designates a coefficient for correcting accuracy of pressure sensor, leakage of the canister closure valve 120 or the like.

That is, when there is a cause of leakage in the hermetically-sealed section from the fuel tank 112 to the purge control valve 123, gas flows out from the hermetically-sealed section to the atmosphere under a state of positive pressure whereas under a state of negative pressure air flows in from the atmosphere to the hermetically-sealed section. Accordingly, "change amount ΔP2 under negative pressure" is larger than "change amount ΔP1 under atmospheric pressure". Further, in this relationship;

the change amount ΔP1 under atmospheric pressure corresponds to "an amount of generating fuel gas in the fuel tank 112−an amount of flowing gas from the hermetically-sealed section to the atmosphere", the change amount ΔP2 under negative pressure corresponds to "an amount of generating fuel gas in the fuel tank 112+an amount of flowing air to the hermetically-sealed section". From the reasoning, the leakage determining condition of the inequality is derived.

Figure 19:
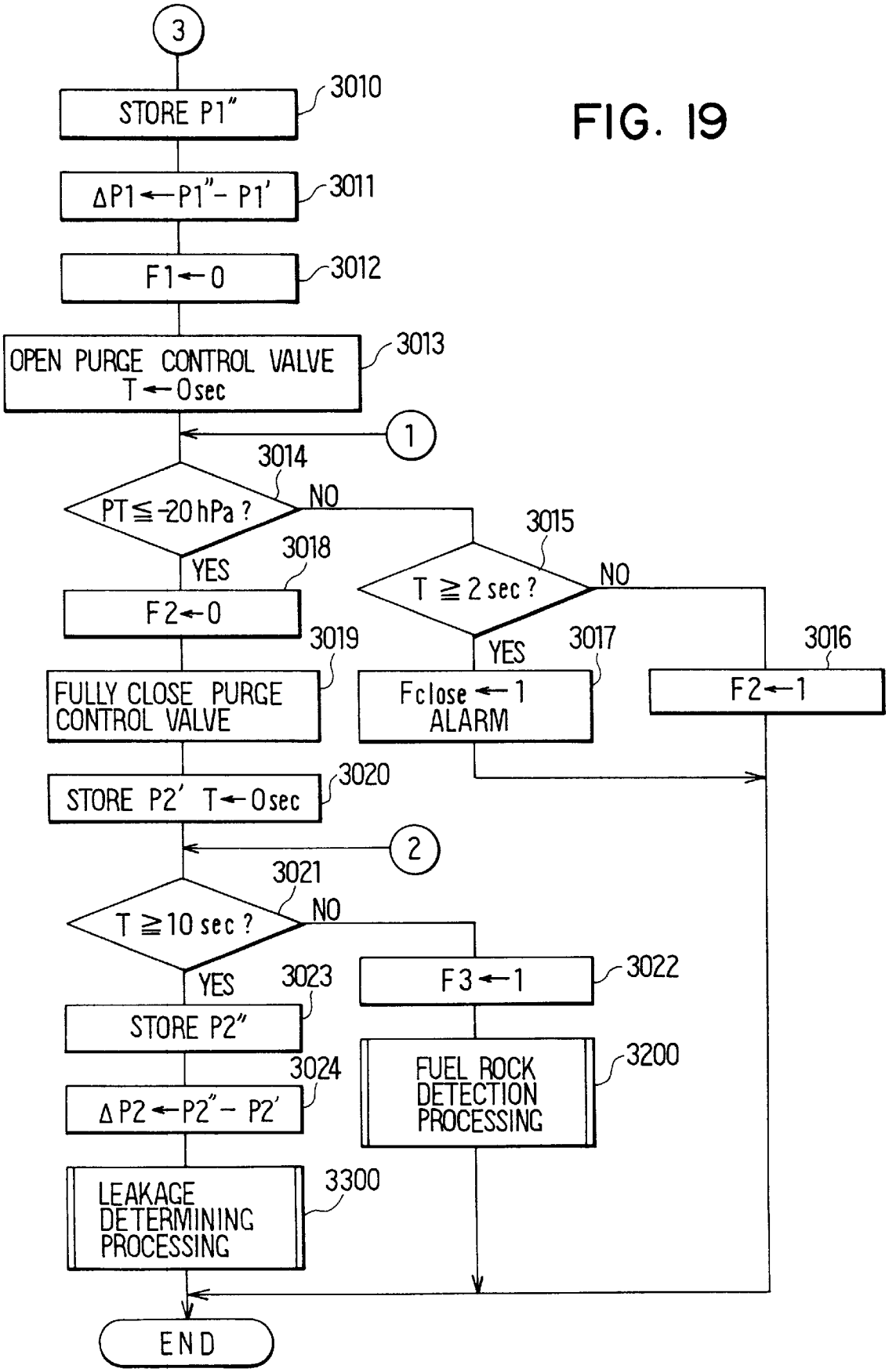
FIG. 19 is a flowchart showing processings of abnormality detection in continuation to FIG. 18.

When the leakage determining condition of the inequality is not established, that is, when step 3301 is negatively determined, CPU 141 proceeds to step 3302, the respective first to the third flags F1 through F3 are forcibly cleared and the operation returns to original abnormality detection processing (processing of FIG. 18 and FIG. 19).

Meanwhile, when the leakage determining condition of the inequality is established, that is, when step 3301 is affirmatively determined, CPU 141 proceeds to step 3303 and determines whether the "rock prediction value" of fuel in the tank which has been calculated by the processing of FIG. 20, is equal to or larger than a predetermined determinant Ks. In this case, rock prediction value<Ks signifies that rocking of fuel in the fuel tank 112 is inconsiderable and a result of the determination at step 3301 is effective and rock prediction value . Ks signifies that rocking of fuel in the fuel tank 112 is considerable and the result of the determination at step 3301 is ineffective.

Accordingly, when step 3303 is negatively determined (case of rock prediction value<Ks), CPU 141 proceeds to step 3304, sets "1" to the purge system leakage flag Fleak signifying that there is a portion causing leakage somewhere in the purge system from the fuel tank 112 to the intake pipe 102 and turns on the abnormality alarming light 129.

Further, when step 3303 is negatively determined (case of rock prediction value . Ks), CPU 141 proceeds to step 3305 and cancels the result of the leakage determination by regarding that establishment of the leakage determining condition at step 3301 is caused by rocking of fuel. Further, thereafter, at step 3306, CPU 141 increments a counter CL by "1". Further, with a condition where the counter CL has reached a predetermined value KC (YES at step 3307), CPU 141 sets "1" to the abnormality detection suspension flag Fn at step 3308 and thereafter returns to the original abnormality detection processing (processing of FIGS. 18 and 19).

Further, in this case, the abnormality detection suspension flag Fn is set based on the value of the counter CL to prevent unnecessary leakage check from being repeated when rocking of fuel is prolonged and by this flag operation, a number of times of opening and closing the canister closure valve 120 or the purge control valve 123 is reduced and durability of the respective valves 120 and 123 is promoted. Incidentally, the abnormality detection suspension flag Fn is reset to "0" after elapse of a predetermined time period (for example, about 1 hour) after setting and the abnormality detection processing is restarted.

Figure 23:
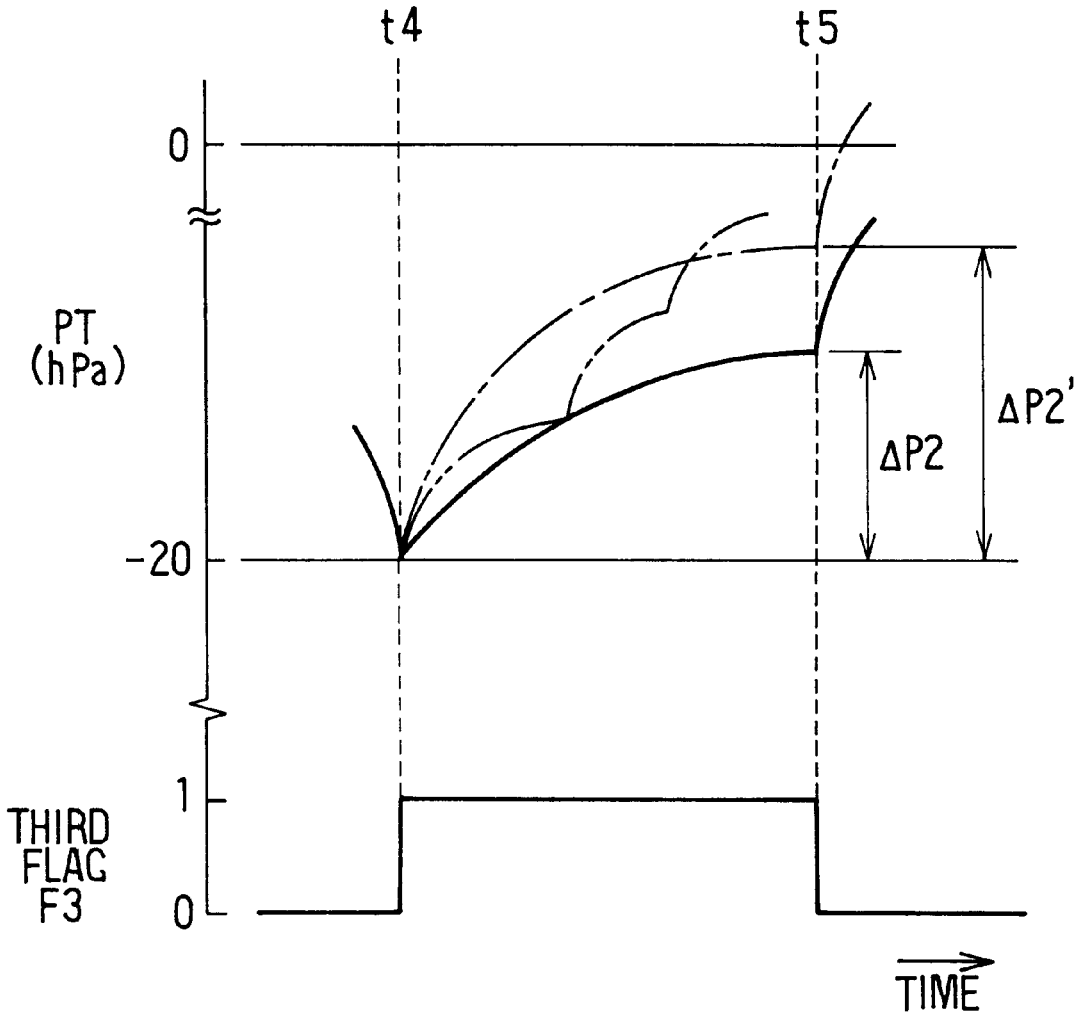
FIG. 23 illustrates time charts for explaining a state of changing pressure in fuel rocking.

FIG. 23 illustrates time charts showing generation of fuel gas and a state of fuel rocking when the hermetically-sealed section from the fuel tank 112 to the purge control valve 123 is brought into a negative pressure state and time points t4 through t5 of FIG. 23 similarly correspond to time points t4 through t5 of FIG. 22 (time period where third flag F3 is set).

In FIG. 23, when fuel rocking is not caused in the fuel tank 112, the tank inner pressure PT rises in a predetermined quadratic curve. In this case, when fuel gas does not leak from the hermetically-sealed section, as shown by a bold line, the tank inner pressure PT is changed in accordance with an amount of generating fuel gas and rises by ΔP2 and when fuel gas leaks from the hermetically-sealed section, as shown by one-dotted chain line, the tank inner pressure PT rises by ΔP2'. Accordingly, the behavior of the one-dotted chain line can be specified to be caused by leakage of fuel gas under the following relationship.

$$\Delta P2' > \Delta P2$$

In contrast thereto, when fuel rocking is caused in the fuel tank 112 as shown by a two-dotted chain line of FIG. 23, a large amount of fuel gas is temporarily generated and the tank inner pressure PT rises while pulsating. When fuel gas is generated by fuel rocking, the change amount ΔP2 under negative pressure is increased even when there occurs no leakage and presence or absence of leakage cannot be determined only by the factor of ΔP2. Accordingly, when occurrence of fuel rocking is detected from the twice change amount d^2PT of the tank inner pressure PT and the fuel rocking is detected, the result of the determination of leakage is made ineffective.

According to the processing explained above, when leakage or closure is caused in the section from the fuel tank 112 to the purge control valve 123 in the fuel gas emission preventing device, the occurrence can always be detected precisely. Further, the abnormality detection can be carried out regardless of a position of attaching the pressure sensor 125.

Further, according to the embodiment, the control of opening and closing the purge control valve 123 and the canister closure valve 120 in accordance with the flowchart of FIG. 18 and FIG. 19 corresponds to pressure adjusting means described in claims and step 3300 of FIG. 19 (processing of FIG. 21) corresponds to abnormality detecting means. Further, step 3200 of FIG. 19 (processing of FIG. 20) corresponds to fuel rock detecting means, steps 3303 and 3305 of FIG. 21 correspond to abnormality detection nullifying means and steps 3306 through 3308 of FIG. 21 correspond to abnormality detection suspending means, respectively.

According to the third embodiment described in details above, there are achieved particular effects shown below.

(a) According to the embodiment, in hermetically sealing the section from the fuel tank 112 to the intake pipe 102, rocking of fuel in the fuel tank 112 is detected from the change amount per time of the pressure in the hermetically-sealed section and when fuel rocking is detected, the result of abnormality detection of the fuel gas emission preventing device is nullified. According to the constitution mentioned above, even when the pressure change state is unpreparedly varied since a motor vehicle is running on a deteriorated road, curving or abruptly stopped, the pressure change can be recognized to be caused by the fuel rocking. That is, erroneous detection of abnormality can be prevented by nullifying the result of abnormality detection in fuel rocking and abnormality of leakage of fuel gas or the like can accurately be detected.

Figure 24:
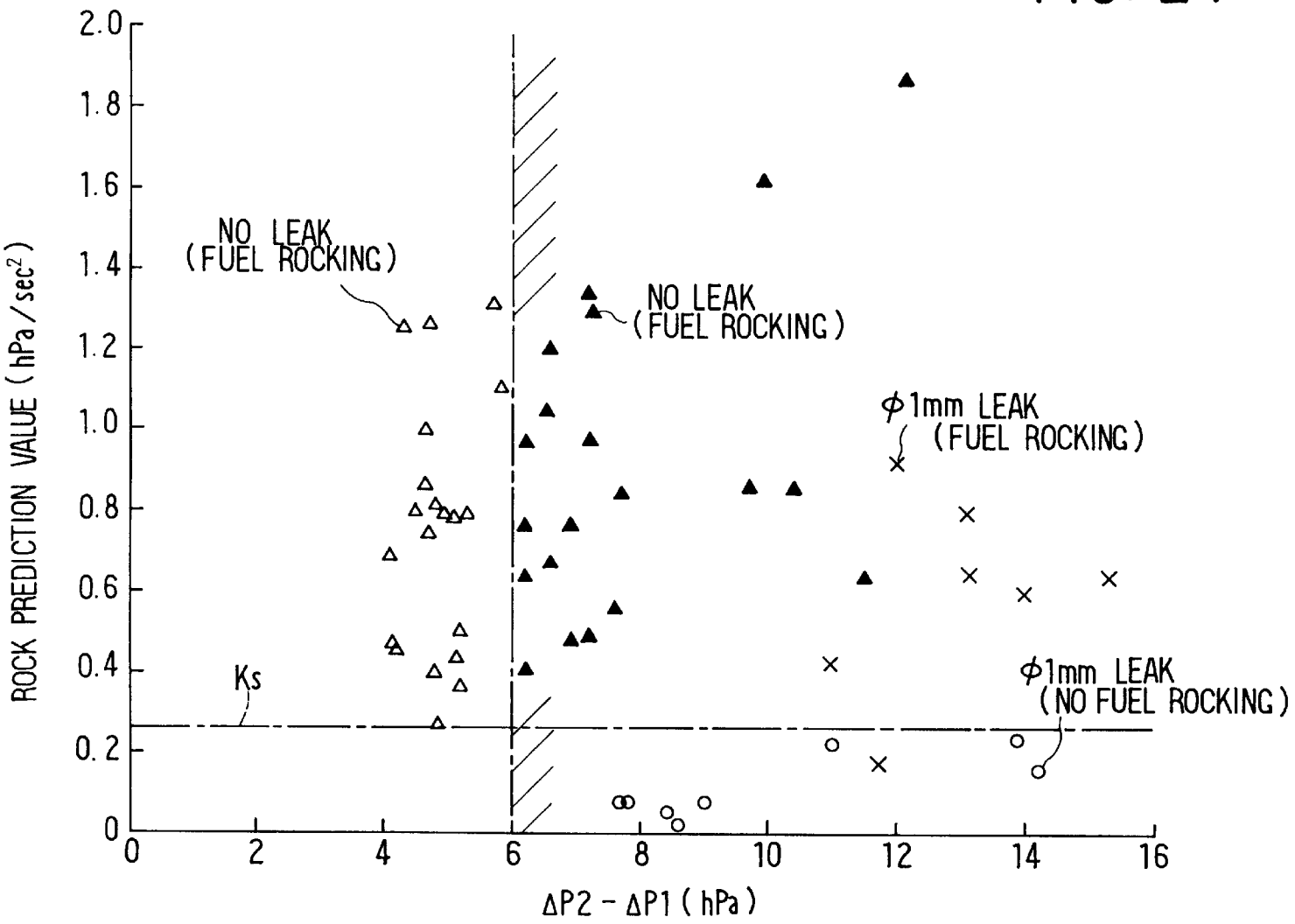
FIG. 24 is a graph for explaining an effect according to a third embodiment.

FIG. 24 is a diagram for confirming the effect according to the embodiment, the ordinate of the diagram designates a rock prediction value and the abscissa designates "ΔP2−ΔP1" in correspondence with the pressure change state. ΔP2−ΔP1>about 6 hPa (region on hatched side of diagram) constitutes an abnormality determining region where occurrence of leakage is to be detected. Further, in the diagram, "○" mark designates data having leakage of ϕ1 mm and no fuel rocking, "×" mark designates data having leakage of ϕ1 mm and having fuel rocking, "Δ, ▲" marks designates data having no leakage and having fuel rocking, respectively.

Accordingly, in conventional abnormality detection where fuel rocking mentioned above is not detected, data of "▲" mark are detected as data having leakage similar to data of marks "○, ×" regardless of the fact that they are data having no leakage. In contrast thereto, according to the embodiment, data where the rock prediction value exceeds the predetermined determinant Ks are nullified and therefore, only data of "○" mark is determined to be effective and erroneous detection of leakage by data of "▲" mark can be prevented. However, according to data of "×" mark, even when there causes leakage of ϕ1 mm, abnormality data is once nullified due to fuel rocking and occurrence of leakage is determined after fuel rocking is converged.

(b) Further, according to the embodiment, the twice change amount d^2PT (differential value in the second order) of the tank inner pressure PT is used as the prediction value of fuel rocking. Accordingly, detection of fuel rocking can be carried out accurately.

(c) Fuel rocking is detected when the pressure in the hermetically-sealed section from the fuel tank 112 to the intake pipe 102 becomes negative pressure, that is, time points t4 through t5 of FIG. 22. Accordingly, the fuel rocking can be detected in a region where fuel gas is liable to generate due to fuel rocking and reliability of the detection result is promoted.

(d) In hermetically sealing the section from the fuel tank 112 to the intake pipe 102, the atmospheric pressure (first predetermined pressure) and −20 hPa (second predetermined pressure) are switched and abnormality of leakage or the like is detected by a result of comparing the pressure change states at the respective pressures. In such a case, when it is assumed that cause of leakage is present, the rate of leakage is varied in accordance with the difference in a relative pressure difference in respect of the atmospheric pressure in adjusting the respective pressure. Therefore, according to the difference between the above-described two pressure change states, presence or absence of leakage or cause of leakage can easily be detected.

(e) When fuel rocking continues for a predetermined time period or more, abnormality detection is once suspended. According to the above-described constitution, if processing of abnormality detection is suspended in, for example, running on a deteriorated road of a long distance. In this case, opening and closing operation of the purge control valve 123 and the canister closure valve 120 is restrained from being repeated more than necessary in order to set a hermetically-sealed section and durability of the respective valves 123 and 120 is promoted.

(f) Although with regard to detection of fuel rocking in the fuel tank 112, a fuel level meter may be installed and the detection may be carried out based on a result of measurement, according to such a constitution, there causes a problem where high cost formation of the system is resulted or a problem where detection accuracy of fuel rocking is not sufficient. In contrast thereto, according to the embodiment, fuel rocking can be detected accurately without causing high cost formation of the system.

(g) According to the conventional existing device, abnormality detection of a fuel gas emission preventing device is carried out when, for example, the vehicle speed is "0" and the vehicle is idling and the abnormality detection is not carried out when fuel rocking may be caused. However, according to the apparatus of the embodiment, fuel rocking is successively detected and the detection result can be reflected to abnormality detection and therefore, the abnormality detection can be carried out even when the vehicle is running.

Further, the embodiments of the present invention can be realized by following embodiments other than described above.

Although according to the embodiments mentioned above, in detecting fuel rocking, the maximum value of the twice change amount d^2PT of the tank inner pressure PT is successively updated during the time period of time points through t5 of FIG. 22 (step 3204 of FIG. 20), presence or absence of fuel rocking is finally determined at a timing of time point t5, the constitution may be changed. The twice change amount d^2PT of the tank inner pressure PT may be compared with a predetermined determinant at every time of calculating thereof, fuel rocking is determined at a time point where the value of d^2PT exceeds the determinant and the abnormality detection (leakage check) by setting the hermetically-sealed section may be carried out at that occasion.

Although according to the embodiments mentioned above, fuel rocking is detected based on the twice change amount d^2PT of the tank inner pressure PT, the constitution may be changed. For example, even when fuel rocking is detected based on the change amount dPT1 (=PT(i)−PT(i−1)) of the tank inner pressure PT, the gist of the present invention is not deviated.

Although according to the embodiments mentioned above, fuel rocking is detected when the pressure in the hermetically-sealed section from the fuel tank 112 to the intake pipe 102 becomes negative pressure, that is, at time points t4 through t5 of FIG. 22, the constitution may be changed. For example, fuel rocking may be detected at the time period of time points t2 through t4 of FIG. 22, in sum, fuel rocking may be detected when the hermetically-sealed section is set.

Although according to the embodiments mentioned above, processing of abnormality detection suspension is carried out (steps 3306 through 3308 of FIG. 21), the processing may be deleted.

Although according to the embodiments mentioned above, in the abnormality detection processings carried out in accordance with the flowchart of FIG. 18 and FIG. 19, after measuring the pressure change state at a vicinity of the atmospheric pressure, the pressure change state under negative pressure is measured, the order may be reversed.

The time periods of pressure adjustment in the abnormality detection processing (time periods of time points t2 through t3, t3 through t4, t4 through t5 of FIG. 22) are not limited to the above-described time periods but may be specified by being pertinently changed in accordance with the specification of engine or the like.

Although according to embodiments mentioned above, the pressure sensor 125 as the pressure detecting means is installed at the fuel tank 112, for example, the pressure sensor 125 may be installed at a section between the canister 111 and the intake pipe 102. Also in this case, leakage determination of a total of the hermetically-sealed section may be carried out based on the pressure change state after constituting the hermetically-sealed section.

(Fourth Embodiment)

According to the fourth embodiment, the abnormality diagnosis apparatus explained in the first embodiment is added with "negative pressure F/B processing" in the second embodiment and "fuel rock detection processing" in the third embodiment.

Figure 25:
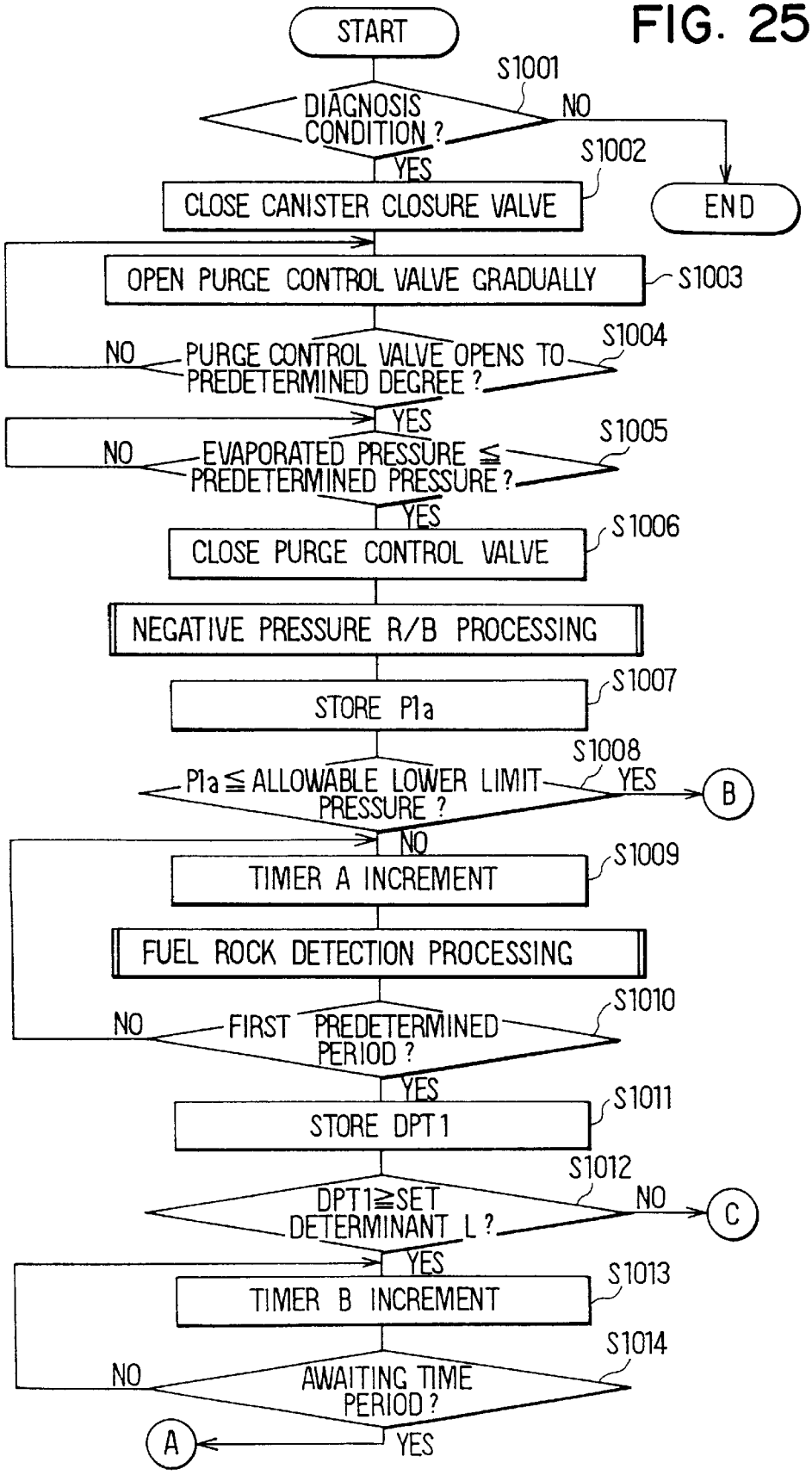
FIG. 25 is a flowchart showing processings of abnormality detection according to a fourth embodiment.

That is, as shown by FIG. 25, "negative pressure F/B processing" explained in the second embodiment is carried out immediately after step 1006 in the first embodiment and "fuel rock detection processing" explained in the third embodiment is carried out immediately after step 1009. Further, by integrating "fuel rock detection processing", immediately after step 1022, whether "rock prediction value" of fuel in the tank calculated at the processing of FIG. 20 is equal to or higher than the predetermined determinant Ks is determined. In this case, when it is determined that the rock prediction value is equal to or more than the determinant Ks, CPU proceeds to step 1026 and opens the canister closure valve. Meanwhile, when "rock prediction value" is determined to be less than the determinant Ks, the operation proceeds to step 1023, determines that leakage abnormality is caused and turns on the alarm lamp.

Figure 27:
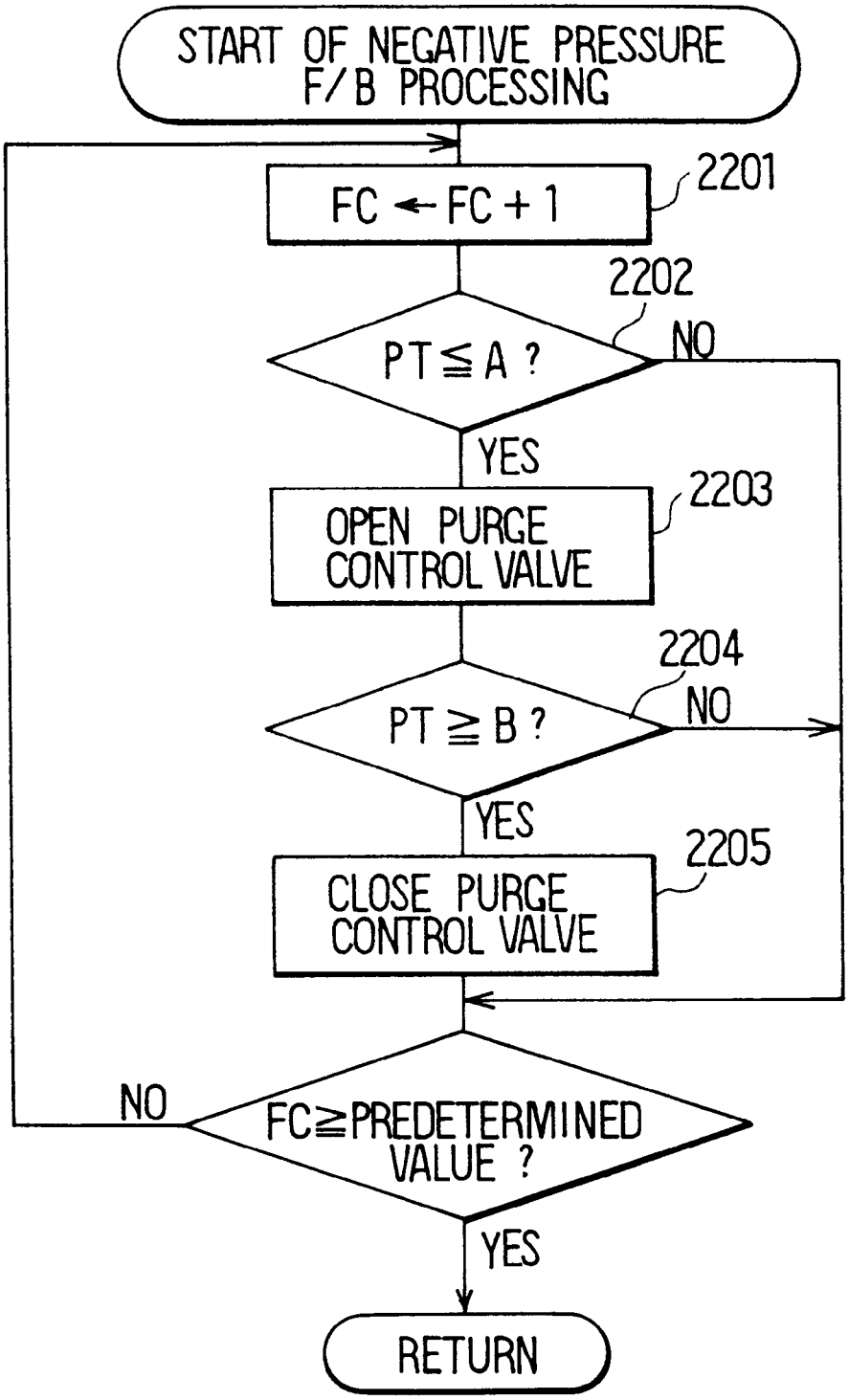
FIG. 27 is a flowchart showing processings of negative pressure F/B.

Further, according to the negative pressure F/B processing, in addition to the negative pressure F/B processing explained in reference to FIG. 11 in the second embodiment, as shown by FIG. 27, a step of determining whether FC value is a predetermined value is inserted immediately after step 2205 and the negative pressure F/B processing is continued and until FC value reaches the predetermined value.

In this way, by also providing the negative pressure F/B processing and the fuel rock detection processing, further accurate leakage abnormality detection can be carried out.

Further, the negative pressure F/B processing and the fuel rock detection processing used in the fourth embodiment can be carried out in the conventional leakage check.

(Fifth Embodiment)

According to the fifth embodiment, the control for carrying out "negative pressure F/B processing" explained in the second embodiment is integrated with "fuel rock detection processing" explained in the third embodiment.

Figure 28:
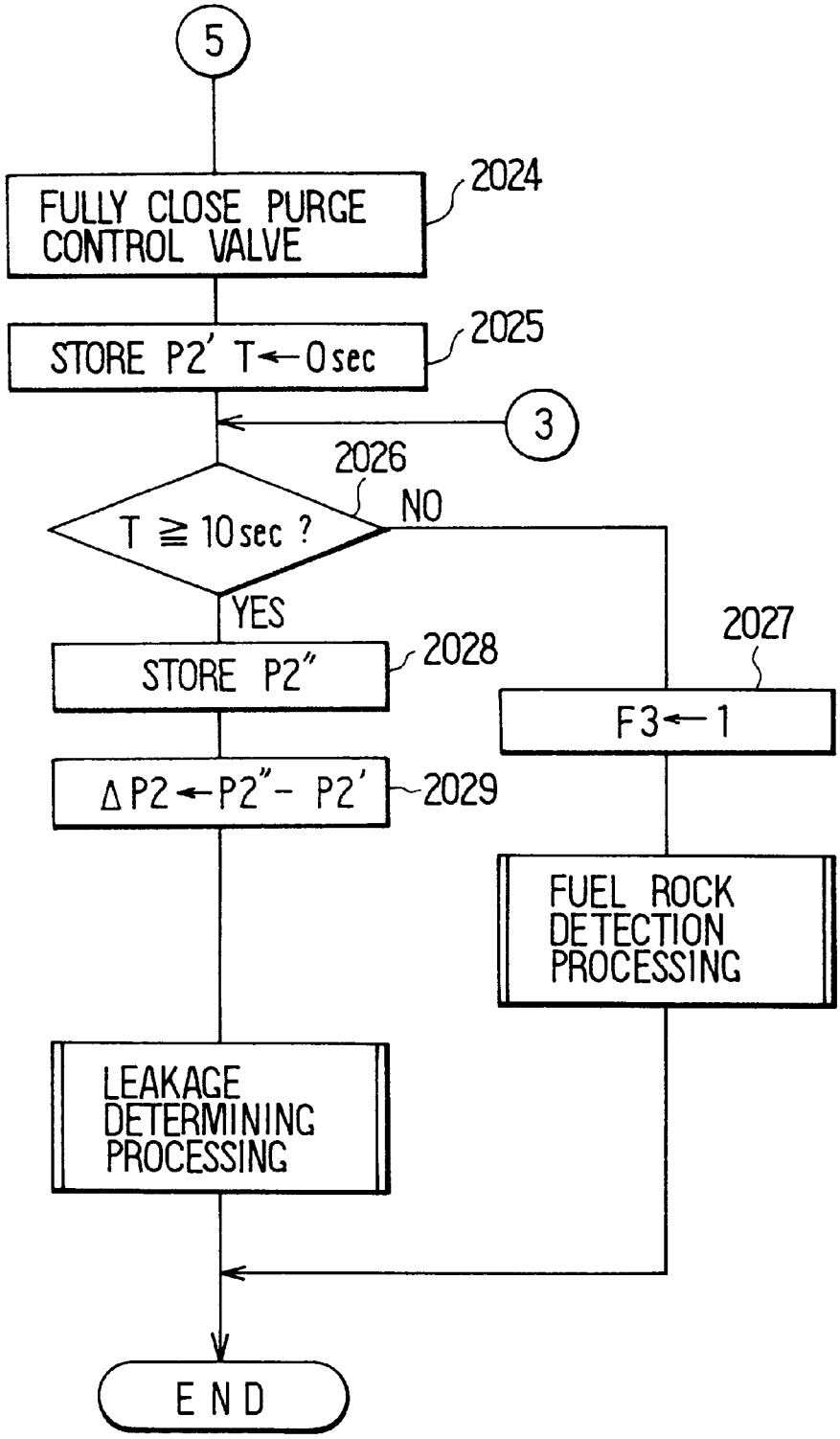
FIG. 28 is a flowchart showing a portion of processings of abnormality detection according to a fifth embodiment.
Figure 29:
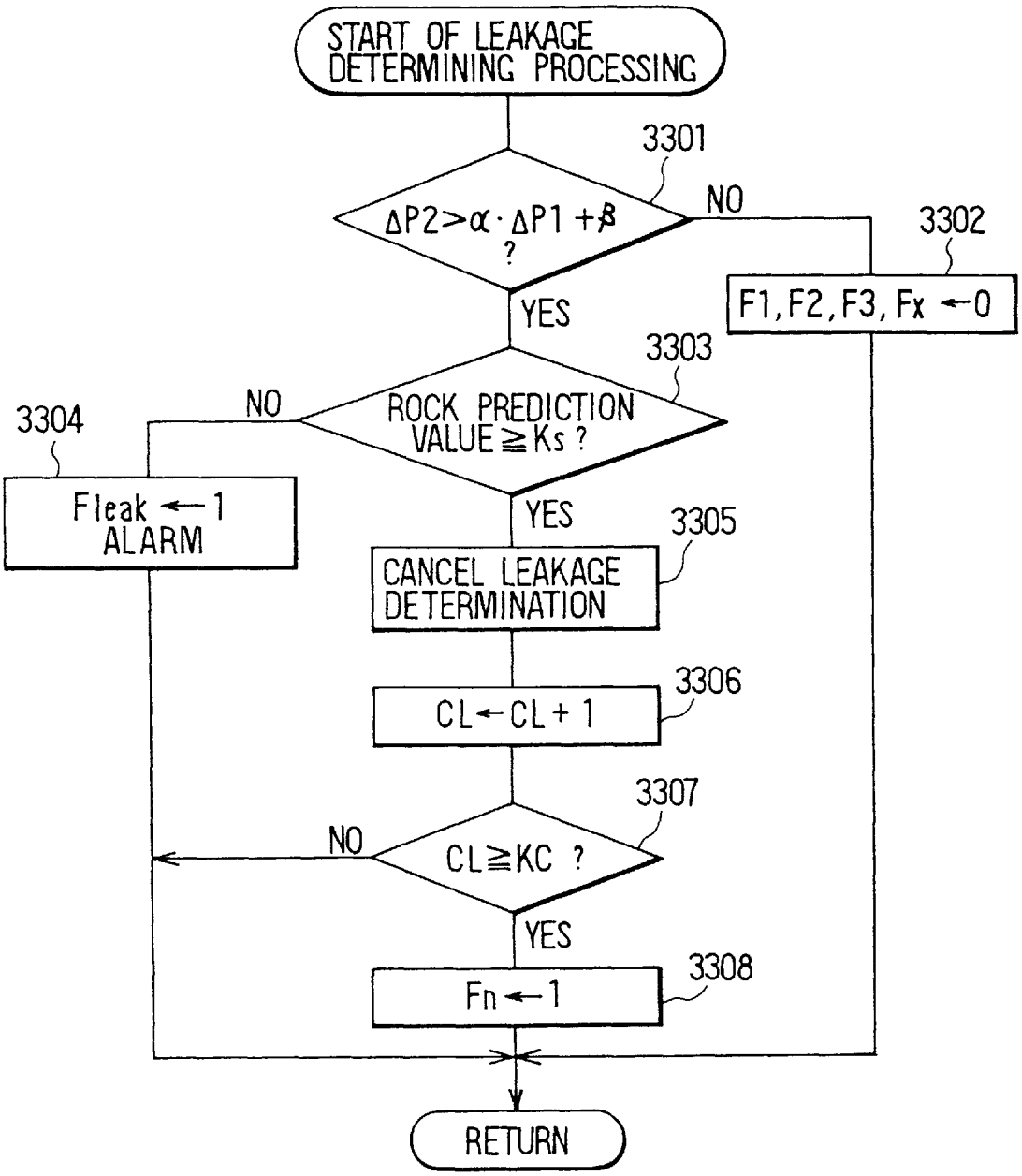
FIG. 29 is a flowchart showing processings of leakage determination according to the fifth embodiment.

That is, as shown by FIG. 28, the fuel rock detection processing is carried out immediately after step 2027 in the control program of the second embodiment and the leakage determining processing is carried out immediately after step 2029. The fuel rock detection processing is similar to that in the third embodiment and the processing is carried out in accordance with the flowchart shown by FIG. 20. Further, also in respect of the leakage determining processings, as shown by a flowchart of FIG. 29, a processing similar to that in the third embodiment is executed.

What is claimed is:

1. An abnormality diagnosis apparatus of an evaporated gas purge system for diagnosing abnormality of an evaporated gas purge system in which evaporated gas produced by evaporating fuel in a fuel tank is absorbed to a canister and the evaporated gas absorbed to the canister is purged to an intake pipe of an internal combustion engine, said abnormality diagnosis apparatus of the evaporated gas purge system comprising:

negative pressure introducing means for introducing a negative pressure (P1*a*) into an evaporated gas system which is from the fuel tank to a purge control valve by closing a canister closure valve installed between the canister and atmosphere and opening the purge control valve installed downstream from the canister when an abnormality diagnosis condition is established;

hermetically sealing means for bringing an inside of the evaporated gas system into a hermetically-sealed state by closing the purge control valve after introducing the negative pressure; and abnormality diagnosing means for diagnosing abnormality of leakage of the evaporated gas system based on a pressure change (DPT1) in the evaporated gas system in a predetermined time period, during a time period where the inside of the evaporated gas system is hermetically-sealed by the hermetically sealing means after introducing the negative pressure, and a pressure (Pmin−Pmax) in the evaporated gas system, during the time period where the inside of the evaporated gas system is hermetically-sealed after introducing the negative pressure and at a predetermined timing after detecting the pressure change.

2. The abnormality diagnosis apparatus of an evaporated gas purge system according to claim 1, wherein the abnormality diagnosing means detects the pressure in the hermetically-sealed evaporated gas system during a second predetermined time period after a predetermined awaiting time period after detecting the pressure change.

3. The abnormality diagnosis apparatus of the evaporated gas purge system according to claim 1, wherein the abnormality diagnosing means determines that the evaporated gas purge system is normal when the pressure change (DPT1) is less than a predetermined change.

4. The abnormality diagnosis apparatus of an evaporated gas purge system according to claim 1, wherein the abnormality diagnosing means determines that the evaporated gas purge system is normal when the pressure (Pmin) detected at the predetermined timing after detecting the pressure change is deviated from a predetermined pressure range.

5. The abnormality diagnosis apparatus of an evaporated gas purge system according to claim 4, wherein the abnormality diagnosing means determines that the evaporated gas purge system is normal when the pressure (Pmin−Pmax) detected during a second predetermined time period after a predetermined awaiting time after detecting the pressure change is deviated from the predetermined pressure range.

6. The abnormality diagnosis apparatus of an evaporated gas purge system according to claim 4, wherein the abnormality diagnosing means sets the predetermined range in accordance with a minimum pressure (P1*a*) of the evaporated gas system when the negative pressure is introduced by the negative pressure introducing means.

7. The abnormality diagnosis apparatus of an evaporated gas purge system according to claim 6, wherein the abnormality diagnosing means increases a lower limit value and/or an upper limit value of the predetermined pressure range with an increase in the minimum pressure (P1*a*).

8. The abnormality diagnosis apparatus of an evaporated gas purge system according to claim 1, further comprising:

fuel rock detecting means for detecting rock of the fuel in the fuel tank; and abnormality determination nullifying means for nullifying the abnormality determination by the abnormality determining means when the rock of the fuel is detected by the fuel rock detecting means.

9. The abnormality diagnosis apparatus of an evaporated gas purge system according to claim 8, wherein the fuel rock detecting means detects rock of the fuel in the fuel tank based on change amounts per time of the pressure in the evaporated gas system (ΔP2, ΔP2') after the evaporated gas system is hermetically sealed by the hermetically sealing means.

10. The abnormality diagnosis apparatus of an evaporated gas purge system according to claim 1, wherein the negative pressure introducing means includes negative pressure maintaining means for introducing a negative pressure (PT) in the evaporated gas system up to a target pressure and maintaining the pressure at the inside of the evaporated gas system at the target pressure for a predetermined time period (t4–t5).

11. The abnormality diagnosis apparatus of an evaporated gas purge system according to claim 10, wherein the negative pressure maintaining means maintains the pressure at the inside of the evaporated gas system at the target pressure for the predetermined time period by controlling an opening degree of the purge control valve.

12. The abnormality diagnosis apparatus of an evaporated gas purge system according to claim 10, wherein the negative pressure maintaining means sets a time period for maintaining the pressure at the inside of the evaporated gas system at the target pressure in accordance with temperature of the fuel in the fuel tank.

13. An abnormality diagnosis apparatus of an evaporated gas purge system in which a canister is installed at a midway of a passage making a fuel tank communicate with an intake pipe of an internal combustion engine, evaporated gas produced by evaporating fuel in the fuel tank is absorbed in the canister, a purge amount of the evaporated gas from the canister to the intake pipe is controlled by opening and closing a purge control valve downstream from the canister in accordance with an operating state of the internal combustion engine and an atmospheric communication hole of the canister is opened and closed by a canister closure valve, said abnormality diagnosis apparatus of the evaporated gas purge system comprising:

pressure detecting means for detecting pressure in an evaporated gas system which is from an inside of the fuel tank to the purge control valve;

diagnosing operation controlling means for closing the canister closure valve and opening the purge control valve and closing the purge control valve in a state where a negative pressure is introduced into the evaporated gas system to thereby maintain the evaporated gas system in a hermetically-sealed state when a diagnosis execution condition is established; and abnormality diagnosing means for diagnosing presence or absence of leakage in the evaporated gas system based on a plurality of pressure changes at respective time periods defined during said hermetically-sealed state, said pressure changes being determined from detected values of said pressure detecting means.

14. The abnormality diagnosis apparatus of an evaporated gas purge system according to claim 13, wherein the abnormality diagnosing means determines that the evaporated gas purge system is normal and suspends the determination of the pressure change when the detected value of the pressure detecting means is deviated from a predetermined pressure range before a second or a later of said time periods starts.

15. The abnormality diagnosis apparatus of an evaporated gas purge system according to claim 13, wherein the abnormality diagnosing means determines that the evaporated gas purge system is normal and suspends the determination of the pressure change when the detected value of the pressure detecting means is deviated from a predetermined pressure range at a second or a later of said time periods.

16. An abnormality detection apparatus of an evaporated gas purge system, in which evaporated gas generated in a fuel tank is stored in a canister and the evaporated gas stored in the canister is discharged to an intake passage of an engine via a purge pipe along with air, said abnormality detection apparatus comprising:

pressure adjusting means for hermetically closing a section from the fuel tank to the intake passage of the engine and adjusting pressure in the hermetically-sealed section to a predetermined pressure;

abnormality detecting means for detecting abnormality of the abnormality detection apparatus from a change in a pressure to the predetermined pressure by the pressure adjusting means; and fuel rock detecting means for detecting rock of fuel in the fuel tank based on a change amount per time of a pressure in the hermetically-sealed section in hermetically sealing the section by the pressure detecting means; and abnormality detection nullifying means for nullifying detection of the abnormality of the abnormality detection apparatus by the abnormality detecting means when the rock of the fuel is detected.

17. The abnormality detection apparatus according to claim 16, wherein the fuel rock detecting means detects the rock of the fuel when the pressure in the hermetically-sealed section becomes a negative pressure.

18. The abnormality detection apparatus according to claim 16, wherein in hermetically closing the section from the fuel tank to the intake passage of the engine, a first predetermined pressure and a second predetermined pressure are switched, a first pressure change state after having been adjusted to the first predetermined pressure is compared with a second pressure change state after having been adjusted to the second predetermined pressure and the abnormality of the abnormality detection apparatus is detected by a result of the comparison.

19. The abnormality detection apparatus according to claim 16, said abnormality detection apparatus including an opening and closing control valve for adjusting a fuel purge amount from the canister to an engine intake system and forming the hermetically-sealed section by having the pressure adjusting means close the opening and closing control valve, further comprising:

abnormality detection suspending means for suspending the detection of the abnormality of the abnormality detection apparatus by the abnormality detecting means when the rock of the fuel continues for a predetermined time period or longer.

20. The abnormality detection apparatus according to claim 16, wherein the fuel rock detecting means detects the rock of the fuel in the fuel tank based on a change amount of the change amount per time of the pressure in the hermetically-sealed section.

21. An abnormality detection apparatus for a fuel gas emission preventing device, in which fuel gas generated in a fuel tank is stored in a canister and the fuel gas stored in the canister is discharged to an intake passage of an engine via a purge pipe along with air, said abnormality detection apparatus comprising:

pressure adjusting means for hermetically sealing a section from the fuel tank to the intake passage of the engine and adjusting a pressure in the hermetically-sealed section to a predetermined negative pressure level;

abnormality detecting means for detecting abnormality of the fuel gas emission preventing device from a change in a pressure after adjusting the pressure by the pressure adjusting means;

negative pressure maintaining means for maintaining the negative pressure level which is adjusted immediately after adjusting the pressure to the negative pressure level by the pressure adjusting means at a vicinity thereof for a predetermined time period; and abnormality detection start permitting means for starting to detect a pressure state for detecting the abnormality after the negative pressure has been maintained for the predetermined time period by the negative pressure maintaining means, wherein the negative pressure maintaining means sets variably the time period for maintaining the pressure at the predetermined negative pressure level in accordance with a temperature of fuel in the fuel tank.

22. The abnormality detection apparatus for a fuel gas emission preventing device according to claim 21, wherein the negative pressure maintaining means maintains the pressure in the hermetically-sealed section at a predetermined negative pressure level by controlling an opening degree of a purge control valve installed at a purge pipe between the canister and the intake passage of the engine by a duty control.

23. The abnormality detection apparatus for a fuel gas emission preventing device according to claim 21, wherein the negative pressure maintaining means sets variably the time period for maintaining the pressure at the predetermined negative pressure level in accordance with a parameter in respect of a space volume of the fuel tank.

24. The abnormality detection apparatus for a fuel gas emission preventing device according to claim 21, wherein the negative pressure maintaining means sets variably the time period for maintaining the pressure at the predetermined negative pressure level in accordance with properties of fuel.

25. An abnormality diagnosis apparatus of an evaporated gas purge system for diagnosing abnormality of an evaporated gas purge system in which evaporated gas produced by evaporating fuel in a fuel tank is absorbed to a canister and the evaporated gas absorbed to the canister is purged to an intake pipe of an internal combustion engine, said abnormality diagnosis apparatus of the evaporated gas purge system comprising:

negative pressure introducing means for introducing a negative pressure (P1*a*) into an evaporated gas system which is from the fuel tank to a purge control valve by closing a canister closure valve installed between the canister and atmosphere and opening the purge control valve installed downstream from the canister when an abnormality diagnosis condition is established;

hermetically sealing means for bringing an inside of the evaporated gas system into a hermetically-sealed state by closing the purge control valve after introducing the negative pressure;

abnormality diagnosing means for diagnosing abnormality of leakage of the evaporated gas system based on a pressure change detected in the evaporated gas system during a first pressure change determining time period, during a time period where the evaporated gas system is maintained in the hermetically-sealed state after introducing the negative pressure, and, when said pressure change amount is greater than or equal to a predetermined amount, a pressure detected in the negative pressure hermetically-sealed evaporated gas system after detecting the pressure change.

26. The abnormality diagnosis apparatus of an evaporated gas purge system according to claim 25, wherein the abnormality diagnosing means determines that the evaporated gas purge system is normal than the pressure change is less than said predetermined change.

27. The abnormality diagnosis apparatus of an evaporated gas purge system according to claim 25, wherein the abnormality diagnosing means detects the pressure in the hermetically-sealed evaporated gas system during a second time period after a predetermined awaiting time period following said first time period, said evaporated gas system being maintained hermetically-sealed during said first time period, said awaiting time period, and said second time period.

28. The abnormality diagnosis apparatus of an evaporated gas purge system according to claim 25, wherein when said pressure detected after said pressure change is deviated from a predetermined pressure range, the system is determined to be normal and the system returns to normal purge control.

* * * * *